US007387176B2

(12) United States Patent
Mellott

(10) Patent No.: US 7,387,176 B2
(45) Date of Patent: Jun. 17, 2008

(54) DOWN HOLE AIR DIVERTER

(76) Inventor: Joseph C. Mellott, P.O. Box 8133, Fort Smith, AR (US) 72902

( * ) Notice: Subject to any disclaimer, the term of this patent is extended or adjusted under 35 U.S.C. 154(b) by 163 days.

(21) Appl. No.: 11/123,596

(22) Filed: May 7, 2005

(65) Prior Publication Data

US 2005/0247487 A1 Nov. 10, 2005

Related U.S. Application Data

(60) Provisional application No. 60/569,317, filed on May 8, 2004.

(51) Int. Cl.
*E21B 7/18* (2006.01)
*E21B 21/10* (2006.01)

(52) U.S. Cl. ..... 175/317; 175/71; 175/324

(58) Field of Classification Search ..... 175/57, 175/296, 317, 324, 424, 71; 166/222
See application file for complete search history.

(56) References Cited

U.S. PATENT DOCUMENTS

| | | | | |
|---|---|---|---|---|
| 3,334,697 | A | 8/1967 | Edwards et al. | |
| 4,260,031 | A * | 4/1981 | Jackson, Jr. | 175/107 |
| 4,540,055 | A * | 9/1985 | Drummond et al. | 175/323 |
| 4,583,603 | A * | 4/1986 | Dorleans et al. | 175/324 |
| 4,615,399 | A | 10/1986 | Schoeffler | |
| 4,645,006 | A | 2/1987 | Tinsley | |
| 4,817,739 | A | 4/1989 | Jeter | |
| 4,834,193 | A | 5/1989 | Leitko, Jr. et al. | |
| 4,844,182 | A | 7/1989 | Tolle | |
| 4,858,704 | A | 8/1989 | McDonald et al. | |
| 4,880,065 | A | 11/1989 | McDonald et al. | |
| 5,407,020 | A | 4/1995 | Beavers | |
| 5,584,352 | A | 12/1996 | Beavers | |
| 5,911,285 | A | 6/1999 | Stewart et al. | |
| 5,944,122 | A | 8/1999 | Cheers | |
| 6,414,905 | B1 | 7/2002 | Owens et al. | |
| 6,637,522 | B2 | 10/2003 | Wilson et al. | |

FOREIGN PATENT DOCUMENTS

JP 2 - 183082 7/1990

OTHER PUBLICATIONS

Lyons, et al, Air and Gas Drilling Manual, 2001, pp. 6-1 through 6-21, 2nd edition ISBN 0-07-039312-5, McGraw Hill, USA.

* cited by examiner

*Primary Examiner*—David J. Bagnell
*Assistant Examiner*—David Andrews
(74) *Attorney, Agent, or Firm*—Charles S. Knobloch; Arnold & Knobloch LLP

(57) ABSTRACT

A down hole air diverter having a first opening in communication with the central passageway of a drillstring; a second opening in communication with the well bore annulus; and a means to control the flow of pneumatic fluid between the first opening and the second opening. The means to control the flow further includes a first sealing means and a first biasing means to control the first sealing means. The first sealing means allows communication with the well bore annulus when the well bore annulus pressure exceeds the first biasing means pressure and prevents communication when the bias pressure exceeds the bore annulus pressure. A second sealing means prevents communication with the drillstring when the pressure from the second sealing means chamber exceeds the first opening pressure and allowing communication when the first opening pressure exceeds the chamber pressure.

28 Claims, 22 Drawing Sheets

Figure 7
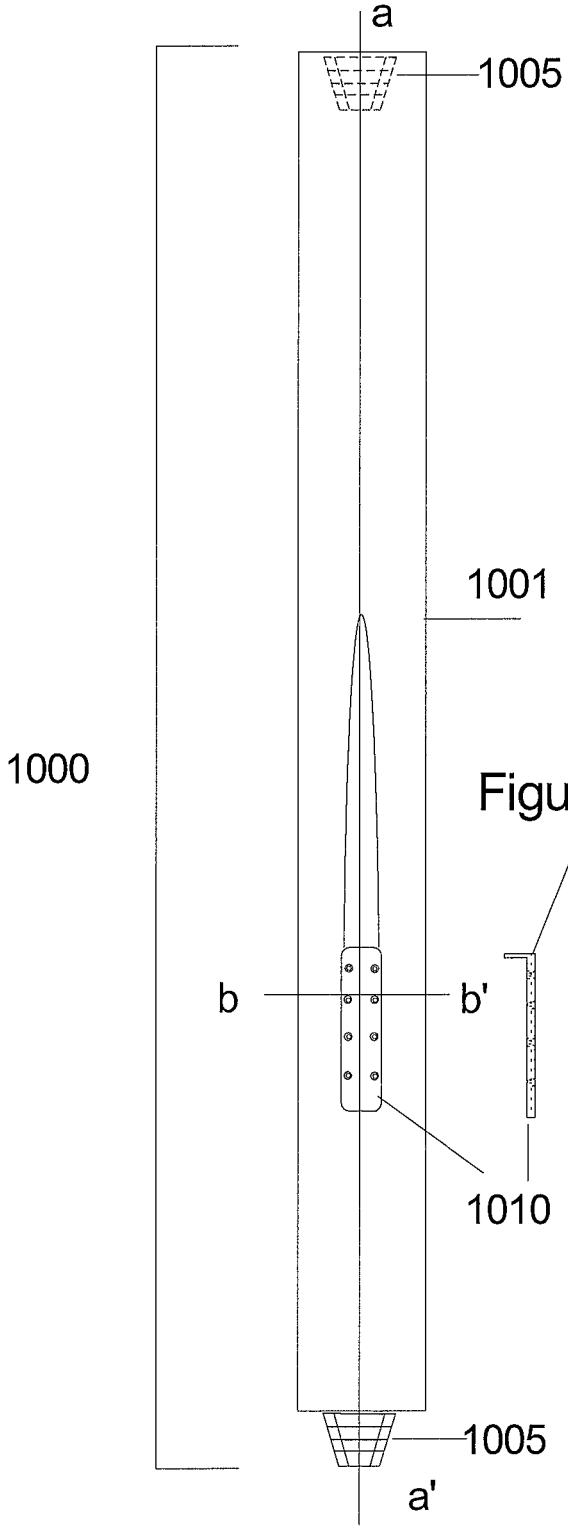
Figure 7A
Figure 8
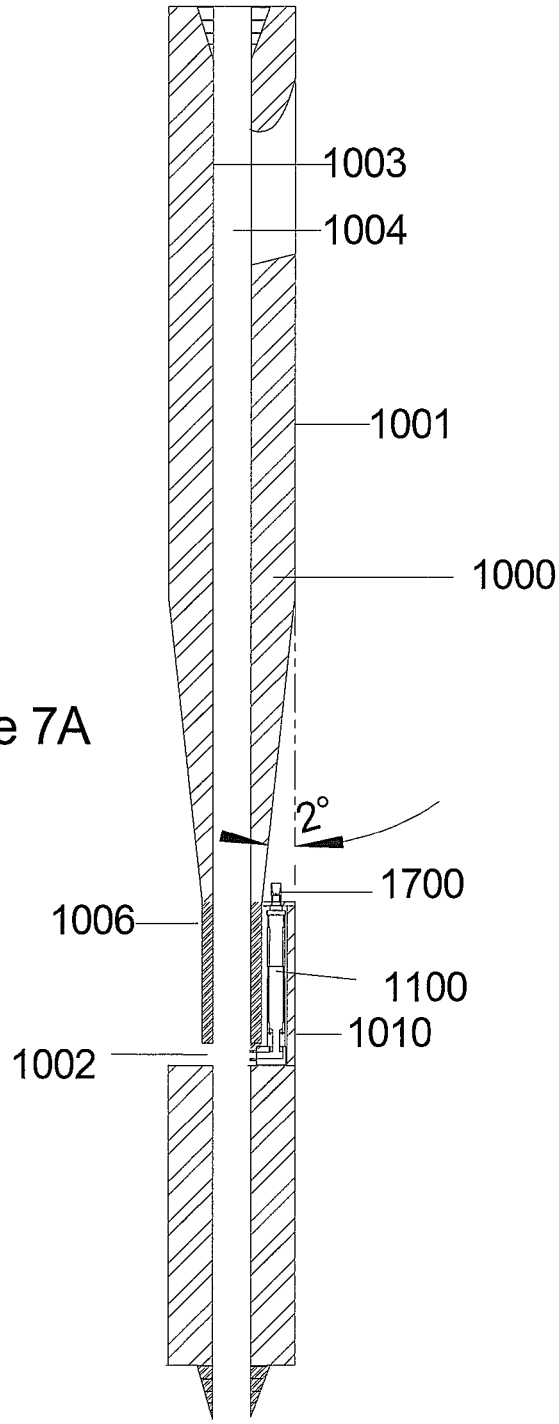

DOWN HOLE AIR DIVERTER

REFERENCE

Pursuant to 35 U.S.C. 119(e)(1), reference is hereby made to earlier filed provisional Patent Application No. 60/569,317 to Joseph C. Mellott for Down Hole Air Diverter of filing date May 8, 2004. This application claims the benefit of U.S. Provisional Application No. 60/569,317, filed May 8, 2004.

FIELD OF THE INVENTION

The present invention relates generally to drilling well bores into subsurface geologic strata. More specifically, it relates directly to the controlled use of a pneumatic fluid as the medium to transport energy to the well bore and bottom hole, and to remove drilled cuttings, injected liquids and liquids produced from these subsurface strata.

BACKGROUND OF THE INVENTION

Typically, a liquid called drilling mud is used to drill well bores. Under certain conditions, a pneumatic fluid, such as air, may be used instead of drilling mud to drill well bores. At first, drilling with a pneumatic fluid initially appears to be less complicated than drilling with a liquid drilling mud. Drilling mud, however, is relatively incompressible when compared to the compressible gases of a pneumatic fluid. Where a particular volume of drilling mud at the surface will effectively have the same volume and other properties at depth, a pneumatic fluid will have a volume that is dependent on pressure, temperature, and flow rate. Conceptual estimates of the action of drilling mud during drilling do not apply when a pneumatic fluid is used. Many drillers in the field either do not fully appreciate these differences, or are not fully able to adapt to these differences in their drilling procedures. Thus, many of the drilling procedures and standards-of-practice used for drilling with drilling-mud are loosely adapted and used when drilling with pneumatic fluid.

Owing to the compressibility of pneumatic fluid, a great amount of control of distribution of energy, pressures, and lift may be obtained in a well bore. The complexity, and the incorrect application of drilling-mud techniques to pneumatic drilling, has generally prevented the industry from taking advantage of this additional level of control provided by pneumatic drilling.

One of the problems of drilling with pneumatic fluid is that all of the pneumatic fluid flows down the drill string, through the drill bit, and up the well bore. Frictional losses are significant. Also, there is no control of the velocity of the pneumatic fluid along the well bore, as changes in the well bore volume will directly affect the compression of the pneumatic fluid. Approximately ten years ago, tools were introduced to the Arkoma Basin which diverted some of the pneumatic fluid out of the drill string into the well bore at various locations, such that not all pneumatic fluid flowed through the drill bit. This short-cut path of pneumatic flow brought several theoretical advantages. First, additional lift was provided in the well bore at the point of diversion. Since this pneumatic fluid did not experience the frictional losses of traveling down to the drill bit and back up to the point of diversion, more energy could be available from the pneumatic fluid to provide lift in the well bore. Second, excess pneumatic fluid flow at the bit can cause excessive erosion of the well bore. Diverting this excess pneumatic fluid flow prior to reaching the bit could decrease damage to the well bore. The diverter could also help dislodge blockages in the well bore, by providing additional lift underneath the blockage. A diverter could also be useful when using a flat bottom bit. Such a bit usually has a percussion or hammer tool connected to the top of the bit. Only a small amount of set-down weight is necessary to operate the hammer tool, which generally reduces well bore drift. A diverter, in theory, helps reduce the amount of pneumatic fluid reaching the hammer tool to the optimal amount needed to drill without waste or hole damage. Unfortunately, many of these promised advantages met with limited success, owing to limitations of the diverters and their method of application.

The significance of the technology and how it could impact air-drilled holes was not fully understood. Setting depths, nozzle sizes and air volumes were not precisely calculated. Without a computer model to augment the diverter tool, it was impractical to select the optimum volume of air to divert, locate where to place the diverter tool, select what nozzle size to use for the valves, and estimate savings from the reduced down hole friction. Many of the promised advantages of using a diverter tool were not realized. The complexities of modeling a compressible pneumatic drilling fluid over a relatively incompressible drilling-mud limited the usefulness of diverter technology.

Therefore, the diverter tool was almost exclusively used to increase penetration rates and stay-on-air while producing large amounts of water. It was very successful in this application. As an example, in West Texas the diverter tools were used to drill at rates of more than one hundred feet per hour, producing 600 barrels of water per hour with a hammer tool and flat bottom bit. Previously, this was not possible without a diverter.

The diverter tools used in the past typically required more pneumatic flow over standard drilling. Hence, little energy savings was realized. Required opening and closing pressure differentials were generally high. These diverter tools operated in a normally closed position, meaning that no pneumatic flow was diverted unless a substantial pressure differential existed between the pneumatic flow in the drill pipe and the well bore. Valve operation of the diverter was completely controlled by the drill pipe and well bore pressure differential. Hence, these diverter valves typically fluttered, causing an unpredictable and erratic amount of diversion. As the pressure in the well bore increased, more pneumatic pressure would have to be pumped into the drill pipe to keep the velocities high enough to balance the higher pressures and keep the valve open. The diverter tool could not be used to selectively control the lift gradient in the well bore, due to its normally closed position and inability to be independently opened by the drill pipe pressure alone.

BRIEF SUMMARY OF THE INVENTION

The present invention includes a down hole air diverter of improved design, a corresponding computer modeling program, and method of application to optimally achieve the benefits of controlled gradient pneumatic drilling.

The Down Hole Air Diverter

The Down Hole Air Diverter is a drillpipe or drillcollar sub equipped with two nozzled valves which are strategically placed in the drillstring to divert a portion of the pneumatic drilling fluid from inside the drillstring into the annulus above the drillcollars. In practice, a drillstring may manifest in a wide variety of combinations of drillpipe, collars, sub assemblies, or other devices. The word "air" when used in the context of the present invention means any compressible pneumatic fluid, such as natural gas, oxygen stripped air, compressed atmospheric air, foam. Depending on the application, there can be one or more of these subs placed in the drilling bottom hole assembly or drillpipe section. Diverting a portion of this air rather than forcing it to travel through the drillcollars, bit and back up the drillcollar annulus, improves flow efficiency while using air as the primary cuttings removal medium. The beneficial effects derived from diverting this air can improve drilling performance and reduce hole erosion, depending on the application. This tool reduces friction pressures and uses this saved energy to improve lift Reducing annular friction pressure increases the pressure drop across the hammer tool, increasing its efficiency.

The Down Hole Air Diverter is a drillpipe or drillcollar sub housing two valves. These two valves are aligned almost parallel to the wellbore with only a two degree taper angle toward the wellbore wall, preventing sub damage due to erosion from the high velocities created when the compressed air exits the valve's sonic nozzle. This angle of diversion also prevents hole erosion from the high velocity at the nozzle exit. This high velocity is only for a small distance from the nozzle exit. Each valve is equipped with an entrance port and exit nozzle so that turbulence through the valve body is minimized. The exit nozzle is a sonic nozzle which is specifically sized for each wellbore configuration. These valves are made of stainless steel to reduce wear as the air and surface injected liquids are channeled through the valve. The valve body, including entrance port and exit nozzles, is approximately eighteen inches (18") long. Included in the valve body is a sleeve, biasing means, and piston assembly, which opens the pathway for the compressed air from inside the drillstring to enter into the annulus. The annular pressure at the exit nozzle forces the piston open by overcoming the biasing means. A unique feature of this valve is that annular pressure opens the valve, yet once the valve is opened, the drillstring pressure, and not the annular pressure, keeps the valve open. Once the valve opens, the drillstring pressure keeps the valve open until a connection is made and drillpipe pressure drops. This prevents valve flutter. This feature also improves predictability of diverted volumes. The piston has a bleeder hole so that drillstring pressure will bleed across and open the valve should the exit nozzle be blocked with debris. The valves will not open should annular pressure drop too low, indicating a blockage below the Down Hole Air Diverter. This allows all available air to be dedicated to clear the blockage in the annulus. The nozzles are sized utilizing a computer model to insure that sufficient air is available to run the hammer tool if drilling with a flatbottom bit and to adequately clean the bottom of the hole. Each valve is also equipped with a check valve to prevent annular fluids from entering the drillstring while making connections or when tripping with flowing gas in the annulus.

The Computer Program

The computer program calculates critical surface and downhole mathematical data necessary to accurately describe the dynamic flowing conditions at the surface and downhole while using a pneumatic fluid as the primary medium to remove drilled cuttings and effluent from the wellbore annulus. It also shows the benefits of diverting a portion of the pneumatic fluid into the annulus before it reaches the bit.

This program uses key input data such as wellbore geometry, drillstring geometry, temperature gradients, surface elevation, compressed air volume/rates, liquid injection volume/rates, drilling rates, rock density, formation liquid production rates and bit type to accurately predict flowing conditions at the surface and downhole in depth intervals inside the drillstring in the wellbore annulus. These results can then be compared to known standards required to drill using a pneumatic fluid as the medium to remove drilled cuttings and effluents from a wellbore. The program presents this data both numerically and graphically and compares results both with and without use of a Down Hole Air Diverter.

Input Data variables include: a) Depth of Down Hole Air Diverter; b) Volume of air to divert; c) Number of Down Hole Air Diverter to use; d) Diverter annular opening pressure; and e) Diverter drillpipe closing pressure.

Program Output results include: a) Optimum depth to deploy Down Hole Air Diverter(s); b) Number of diverters to use; c) Optimum air to divert; d) Optimum nozzle tip opening size necessary to divert the recommended amount of air; e) Surface drillpipe pressures; f) Compressor Horsepower saved by using the diverter; g) Dollar savings in fuel by using the Down Hole Air Diverter; h) Spring sizes necessary open and close the Down Hole Air Diverter at the desired pressures.

This model is patterned after work done by Angel as shown in the 2001 Update of the "*Air and Gas Drilling Manual*." With the aid of the computer program, any number of variables can be changed and the results to the whole drilling system quickly evaluated. This gives one the ability to fine tune the system design in minutes rather hours. The mathematic calculations have not lent themselves to easy use in the field, but with this program field application has been simplified. The program can be used to design an air system with or without the Down Hole Air Diverter in place so that benefits of using the diverter can be demonstrated.

The Method of Application

The use of the computer program combined with the Down Hole Air Diverter allows a pneumatic drilling system to be evaluated in a holistic approach, rather than "two compressors and a hammer tool with a flat bottom bit". Using the computer program, each piece of the "puzzle" in the drilling phase such as volume-rate of fluid, wellbore geometry, and drillstring geometry is profiled. Existing equipment can be profiled and compared to possible alternatives to improve the whole drilling system. By profiling this numerically and graphically it is easy to see where the major energy losses occur in the drilling system and allows consideration of alternatives to reduce these losses, including choosing to use the Down Hole Air Diverter. By using the computer program to profile many "air drilling situations" it becomes apparent that a normally open orifice valve such as the present invention can be used in many situations to significantly improve the overall drilling system.

A second method of application is to use the drilling system to reduce energy losses due to friction. The drilling system must be designed to provide sufficient energy to remove the cuttings from the largest and deepest annular section of wellbore, which has the lowest amount of kinetic energy or power. This can occur at any depth but many times occurs at the bottom of the drill pipe. Mathematically, describing the physics of pneumatics fluid drilling, it has been determined that a minimum of three foot-pounds per cubic foot kinetic energy is necessary at that low energy point in order to clean the wellbore annulus. This kinetic energy is supplied primarily by the velocity of the moving pneumatic fluid. However, in order to get that velocity to this low energy point, the pneumatic fluid must traverse down the inside passageway of the entire drillstring and traverse back up the wellbore annulus. Generally, the drill collars have only 25% of the inside area in this passageway and sometimes have only half the annular area. Therefore, much of the energy necessary to get the pneumatic fluid to the low energy point where it is needed is consumed by friction inside and outside the drill collars. Up to 70% of the energy supplied by the surface compressors is used to overcome friction. By using the present invention, much of the loss due to friction can be avoided. Furthermore, most of this energy is actually reapplied to supply lift to the wellbore annulus. Depending on the individual system, a significant reduction in compressor horsepower is realized.

A third method of application is to use the drilling system to provide controlled gradient lift, thereby reducing bottom hole pressure. The diverted pneumatic fluid supplies lift to the annulus through the "venturi effect" occurring at the Down Hole Air Diverter's exit nozzle. This lift reduces the back pressure in the wellbore annulus below the Down Hole Air Diverter, improving bottom hole cleaning and drilling performance, especially if utilizing a percussion hammer with a flat bottom bit.

A fourth method of application is to use the drilling system to optimize efficiency and performance of a hammer tool. This is accomplished by controlling the amount of pneumatic fluid needed by the hammer tool to operate at its maximum efficiency. This amount is considerably less than that to needed to clean the largest and deepest wellbore annulus. Therefore, a choke is usually placed in the hammer tool at the bit to divert the excess air. Therefore, much energy that is expended to get the pneumatic fluid to the hammer tool is wasted. This wasted energy may also damage the wellbore. Secondly, a hammer tool works directly as a result of the difference in pressure directly above the hammer tool inside the bottom of the collars and in the annulus at the bit. Therefore, any pneumatic fluid that is diverted around the hammer tool piston through a choke reduces the hammer tool's efficiency. By installing a Down Hole Air Diverter above the collars and diverting the pneumatic fluid that is bypassing the hammer tool through a choke, the energy, which would be wasted, can be used to provide lift in the annulus through the "Venturi Effect".

A fifth method of application is to use the drilling system to produce better draw down when dusting. When "dusting", producing no formation fluids while drilling geologic strata, the Down Hole Air Diverter should be placed closer (usually within thirty feet) to the hammer tool so that the Venturi Effect can produce a better drawdown. This energy can be used to keep back pressure in the annulus created by drilled cuttings, injected liquids and liquids entering the wellbore from penetrated geological strata from putting too much back pressure on the bit.

A sixth method of application is to use the drilling system to maintain the ability to pneumatically drill in the presence of large amounts of formation water. It is especially beneficial when using a hammer tool to drill while a large amount of formation water is entering the wellbore. Once the formation water volume-rate exceeds twenty barrels per hour, a conventional tri-cone bit must be used, which reduces penetration rates. Using the Down Hole Air Diverter, placed at the top of the collars to substantially reduce back pressure, a hammer tool can be effective even while producing up to 600 barrels of water per hour.

A seventh method of application is to use the drilling system to control the lift gradient in soft formations or washout zones. This diversion also improves wellbore gauge in geologic strata that are poorly compacted. Hole erosion as a result of too much pneumatic fluid in a small wellbore annulus is the primary cause for cessation of "pneumatic fluid drilling". This erosion results in larger annular wellbore sections, which can not be properly cleaned by the volume rate of pneumatic fluid being used. Fill begins to accumulate in the washed-out sections and sticks the drillstring inside the wellbore annulus when the compressed air is removed from the drillstring. Typical practice is to add additional compressed pneumatic fluid to the drillstring at the surface, increasing internal and external friction pressure, eroding the wellbore even more. The Down Hole Air Diverter can eliminate hole erosion by reducing friction pressures.

An eighth method of application is to use the drilling system to avoid switching to water or oil-based mud. Keeping the drilling operation on a pneumatic fluid system can save tens of thousands of dollars and prevent the conversion to a liquid mud system, which is expensive, and has a serious environmental impact often seen when oil-based mud is used. Secondly, if diverting the unneeded pneumatic fluid away from the bottom hole assembly fails to improve the erosion sufficiently, then any supplemental pneumatic fluid would best be diverted around the bottom hole assembly through the Down Hole Air Diverter.

BRIEF SUMMARY OF THE INVENTION—OBJECTS AND ADVANTAGES

A primary environmental advantage of the present invention is the reduction in types of situations where oil based mud may be required to accomplish drilling to the target objective. By increasing the number of situations where the drilling may be completed without resort to switching from pneumatic fluid drilling to liquid or oil based mud drilling, significant reduction in environmental impact and cost savings may be obtained.

Another advantage which is also related to environmental impact is the reduction in total energy usage required to drill a well. Through the use of the computer modeling or the valve of the present invention, either each alone or both in combination using the described method of operation, a reduction in required pneumatic fluid pressure is achieved. Reduced pressure requirements lead to reduced horsepower needs for generating pressure, which ultimately leads to overall energy usage savings. To date, tests show an actual energy savings of at least 15%, although higher percentage savings are anticipated as experience is obtained in practicing the present invention.

An object of the present invention is to reduce the washout of soft formations caused by wasted friction energy put into the annulus at the bit.

A further object of the present invention is to reduce the bottom hole pressure, thereby achieving better energy coupling at the bit and optimizing the rate of penetration.

Another object of the present invention is to reduce unwanted hole deviation while using a hammer tool and flat bottom bit. This is accomplished by reducing the weight necessary to fully close the hammer tool, thereby reducing the tendency for the hammer tool to drift.

Another advantage of the present invention is that no additional pneumatic fluid is needed to clean the hole.

An object of the present invention is to enable underbalanced drilling in more situations.

Another advantage of the present invention is the significant reduction in moving parts and increased reliability through design, whereby the invention is designed to last through the complete drilling of the hole without failure and without need for replacement of parts or consumable components.

A significant object of the present invention is to isolate control to a single component, being the nozzle tip, of the total volume for a given pressure which may flow through the valve assembly. This allows changing the total volume specification, for a given pressure, by simply changing one component, namely the nozzle tip.

An object of the present invention is to provide for easy change out of the nozzle tip, as deemed necessary for optimum performance with respect to the drilling situation.

Another advantage of the present invention is that it is possible to perform a simple test in the field to verify and insure the valve is properly functioning.

Another object of the present invention is to prevent backflow from the well annulus through the valve assembly back into the drill string combination. This reduces the chance of complete blockage of the valve, debris and unwanted liquids entering the valve, and entry of natural gas entering the drill string combination, thereby reducing the chance of fire or explosion.

An advantage of the present invention is the use of a plate to hold the valve so that in the event of a broken valve, the valve is replaceable in the field.

A significant advantage of the present invention is to extend the range of pneumatic drilling when using a hammer tool and flat bottom bit, when producing water in the hole. Normally, air drilling is not practical or possible when produced % water rates exceed approximately fifty (50) barrels per hour. The present invention extends the ability to pneumatically drill with produced water rates at least up to six hundred (600) barrels per hour.

An advantage of the present invention is the shorter length of the down hole air diverter, approximately six feet (6') over current practice of approximately sixteen feet (16').

A significant safety advantage of the present invention is the reduced chance of downhole ignition.

Another object and advantage of the present invention is to enable calculation of the optimum pneumatic drilling parameters and valve configuration, without the need for significant on-site engineering expertise.

Another advantage of the present invention is the two-piece screw configuration of the valve body assembly, allowing for easy in-field replacement of the piston-sleeve assembly.

An advantage of the present invention is a reduction in annular pressure at the bottom of the hole. For any given circulating volume, the lower the annular pressure at the bit, the more efficient the effect of drilling and lift of cuttings and liquids. The reduced bottom hole pressure reduces the tendency to erode the hole.

An advantage of the present invention, especially through the use of computer modeling, is the reduction in wear of the hammer tool by diverting excess pneumatic fluid away from the bit.

An object of the present invention is the elimination of the need for a choke when using a hammer tool, having the advantage of reducing the backpressure on the bit and reducing the amount of pressure needed to close the hammer.

An object of the present invention is to improve the penetration rates when using a hammer tool and flat bottom bit. Improvements often to forty percent (10% to 40%) are experienced with the present invention. Penetration rate is also improved with an insert bit.

Another object of the present invention is to reduce the overall pneumatic friction losses while controlling optimum pneumatic pressure and volume at the drill bit. An advantage is a reduction in the surface pressure requirements, which may be possible to be reduced by as much as fifty percent (50%) in some situations.

Another object and advantage of the present invention is the reduction of low velocity zones in the well bore. Low velocity zones may be caused by increases in well bore area, due to reductions in drill pipe diameter at drill collars or by washout zones in the geologic strata. The ability to transport cuttings is reduced in these zones, causing unwanted redeposit of the cuttings prior to their reaching the surface. With proper adjustment, pneumatic velocities in the wellbore may be controlled so as to gradually increase from bottom of the hole to the surface, thereby allowing more efficient transport of cuttings and fluid to the surface.

An object of the present invention is to operate the valve in a normally open position, thereby continuously diverting a specific amount of pneumatic fluid into the well bore annulus. This has the advantage of creating a homogeneous combination of pneumatic fluid, produced liquids, injected liquids, and cuttings, with an object to reduce slugging.

An object of the present invention is to eliminate flutter of the valve. This has the advantage of producing a more predictable and less erratic diversion of pneumatic fluid into the well bore annulus, with the object of improving the ability to keep the hole clean.

BRIEF DESCRIPTION OF THE SEVERAL VIEWS OF THE DRAWING

The present invention and its advantages will be better understood by referring to the following detailed description and the attached drawings in which:

FIG. 7 is a side view of the Down Hole Air Diverter 1000 of the present invention, further illustrating a front view of valve plate cover 1010 and identifying the location of longitudinal cross section a-a' and horizontal cross section b-b'.

FIG. 7A is a side view of valve plate cover 1010.

FIG. 8 is a side cross section view of the Down Hole Air Diverter 1000 of the present invention, whose location is identified by longitudinal cross section a-a' in FIG. 7.

REFERENCE NUMERALS IN DRAWINGS

Components

Figure 1:
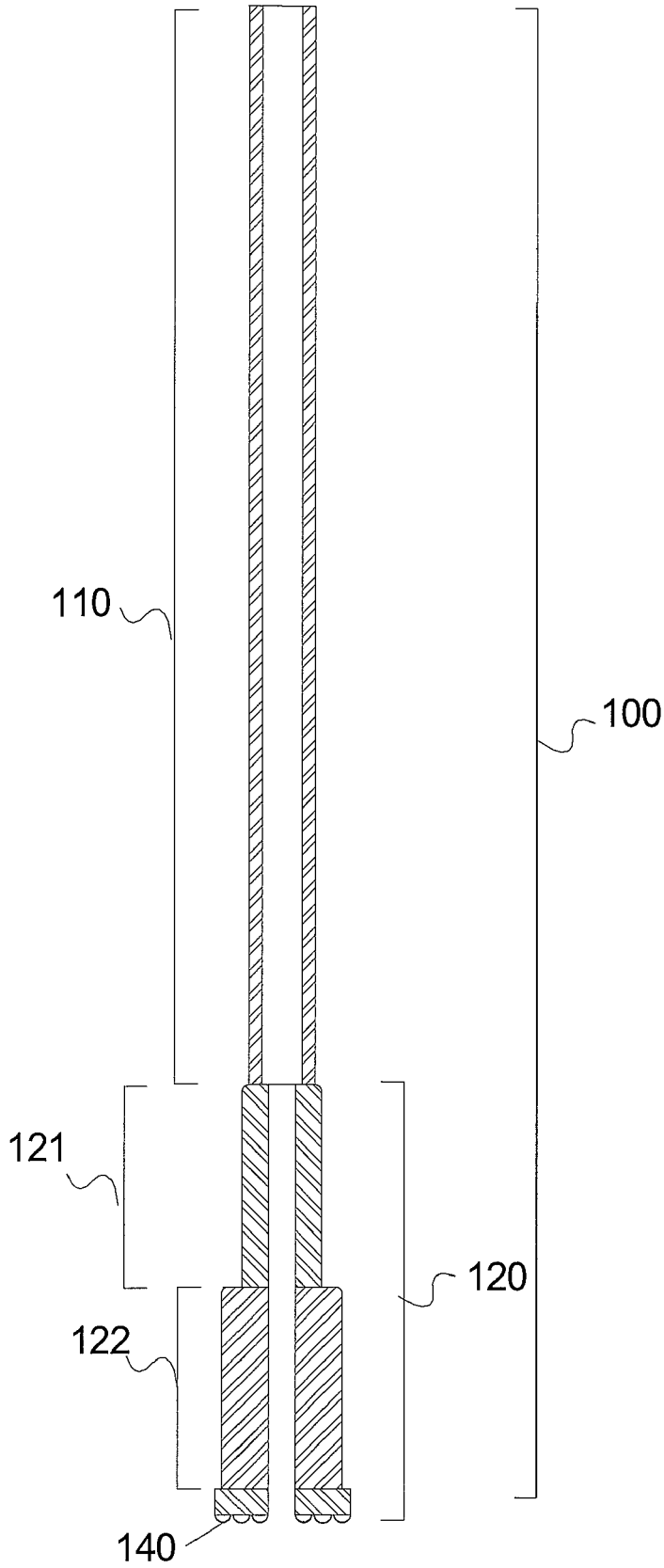
FIG. 1 is a cross-sectional side view of the drillstring combination 100, including bottom hole assembly 120.

100 drillstring combination
- 110 drillpipe
- 120 bottom hole assembly
  - 121 drill collar
  - 122 drill collar
  - 140 drill bit

8 blooie line
9 pneumatic inlet piping
20 casing
30 uncased sidewall
40 geologic strata
50 washout zone
60 well bore
61 well bore annulus
1000 Down Hole Air Diverter
- 1001 diverter sub
- 1002 openings
- 1003 inner surface
- 1004 central passageway
- 1005 threadable attachment means
- 1006 outer surface
- 1010 valve plate cover
- 1100 valve assembly
  - 1200 entrance port assembly
    - 1210 entrance port hex nut
    - 1220 entrance port o-ring
    - 1230 check ball seat
    - 1240 valve body o-ring
  - 1300 outer valve body assembly
    - 1310 lower valve body
    - 1320 upper valve body
    - 1321 upper sleeve seat
  - 1400 piston-sleeve assembly
    - 1405 upper piston
    - 1406 upper piston top o-ring
    - 1407 upper piston bottom-rings
    - 1408 bleeder
    - 1410 piston sleeve
    - 1411 standoff protrusions
    - 1412 lower chamber
    - 1413 upper chamber
    - 1414 spring seat
    - 1420 lower piston
    - 1430 lower piston retainer
    - 1440 lower piston compression spring
    - 1450 check ball
    - 1460 lower piston o-ring
  - 1600 exit nozzle
    - 1610 upper piston seat
    - 1620 exit nozzle o-ring
  - 1700 nozzle tip
    - 1710 nozzle tip ports
  - 3010 pressure chamber
  - 3020 valve passageway

Software Flowchart—Computation Results

Annulus Pressure Versus Depth R1, calculated by computing function F12.

Drillpipe Pressure Versus Depth R2, calculated by computing function F20.

Air Velocity Versus Depth R3, calculated by computing function F15.

Kinetic Energy Versus Depth R4, calculated by computing function F16.

Nozzle Size R5, calculated by computing function F21.

Compressor Horsepower Hours R6, calculated by computing function F22.

Daily Diesel Consumed R7, calculated by computing function F23.

Daily Cost R8, calculated by computing function F24.

Software Flowchart—Computing Functions

Gas Density At Surface F1
Average Temperature Versus Depth F2
Weight Rate Gas Flow F4
Weight Rate Solids Flow F6
Outside Constant A F7
Outside Constant B F8
Weight Rate Injected Fluid Flow F9
Weight Rate Produced Liquids Flow F10
Annulus Pressure F12
Gas Density Downhole F13
Downhole Flowrate F14
Internal Friction Factor A F17
Internal Constant A F18
Internal Constant B F19
Drillpipe Pressure F20
Compressor Horsepower Hours F22
Daily Diesel Consumed F23

Software Flowchart—Data Inputs

Mean Surface Temperature D2
Temperature Gradient D3
Surface Atmospheric Pressure D4
Mist Or Dust Drilling Flag D9
Bit Type Flag D10
Gas Specific Gravity D11
Specific Gravity Solids D12
Specific Gravity Of Injected Fluids D13
Specific Gravity Of Produced Fluids D14
Flat Bottom Bit Design Pressure D15
Drilling Rate D17
Actual Injected Air D21
Specific Heat of Air D22
Compressor Input Temperature D23
Compressor Output Temperature D24
Compressor Output Pressure D25
Number of Compressor Stages D26
Casing Inside Diameter D28
Bit Size D30
Bit Nozzle Orifice Inside Diameter D31
Open Hole TD D32
Blooie Line Outside Diameter D34
Blooie Line Outside Diameter D35
Blooie Line Length D36
Open Hole Absolute Roughness D37
Actual Volume Of Injection Water D38
Number of Diverters D39
Depth of Diverter One D40
Diverter One Diversion Volume D41
Depth of Diverter Two D42
Diverter Two Diversion Volume D43
Drill Pipe Outside Diameter D44
Drill Pipe Inside Diameter D45
Drill Pipe Length D46
Drill Collar 1 Outside Diameter D47
Drill Collar 1 Inside Diameter D48
Drill Collar 1 Length D49
Drill Collar 2 Outside Diameter D50
Drill Collar 2 Inside Diameter D51
Drill Collar 2 Length D52
Absolute Roughness D53
Estimated Depth To Base Of Water D54
Estimated Produced Water Rate D56
Hole Diameter In Affected Area D59
Booster Used Flag D60
Number Of Booster Stages D61
Diesel Cost D62
Diesel Consumption D63

Method of Application Flowchart

P100 Gather data inputs D1 through D63 for entry into the Network Analysis Module of the computer program. Set an initial value for Actual Injected Air D21.

P200 Execute Network Analysis Module: Compute functions F1 through F24, producing computational results R1 through R8.

P300 Iteratively execute Network Analysis Module, adjusting Actual Injected Air D21, and alternatively other data inputs, until an acceptable profile for Kinetic Energy Versus Depth R4 is achieved.

P400 Iteratively execute Network Analysis Module, adjusting Diverter One Diversion Volume D41 and Diverter Two Diversion Volume D43, to divert pneumatic fluid away from bottom hole assembly 120, until an acceptable profile for Kinetic Energy Versus Depth R4 or Air Velocity Versus Depth R3 is achieved.

P500 Set compression rating of lower piston compression spring 1440.

P600 Use computational result Nozzle Size R5 to set the diameter of nozzle orifice 1710 of nozzle tip 1700 for each valve assembly 1100 to be installed in Downhole Air Diverter Sub 1000.

P700 Install one or more Down Hole Air Diverters 1000 in drillstring combination 100.

P800 Use accepted data input Actual Injected Air D21 to set the total flow of the surface air compressors to drillstring combination 100.

P900 Commence drilling operations.

DETAILED DESCRIPTION OF THE INVENTION

Down Hole Air Diverter

A typical drilling configuration is shown in FIG. 1. Drillstring combination 100 comprises a plurality of drillpipe 110 attached end to end, having a passageway along its axis, and connected to a bottom hole assembly 120. In practice, any of a wide variety of components may comprise drillstring combination 100. Bottom hole assembly 120 comprises a plurality of drill collars 121, which typically have an outside diameter greater than drillpipe 110, and optionally a plurality of drill collars 122 of larger outside diameter, and drill bit 140. The passageway of drillpipe 100 typically has a diameter greater than the passageway of drill collars 121 and drill collars 122. The flow area created by the diameters of the passageway of drill collar 121 is typically at least three times smaller than the flow area created by the diameter of the passageway of drillpipe 110. Therefore there is typically a significant amount of available pneumatic fluid energy at the end of drillpipe 110, just above the top of bottom hole assembly 120.

Figure 2:
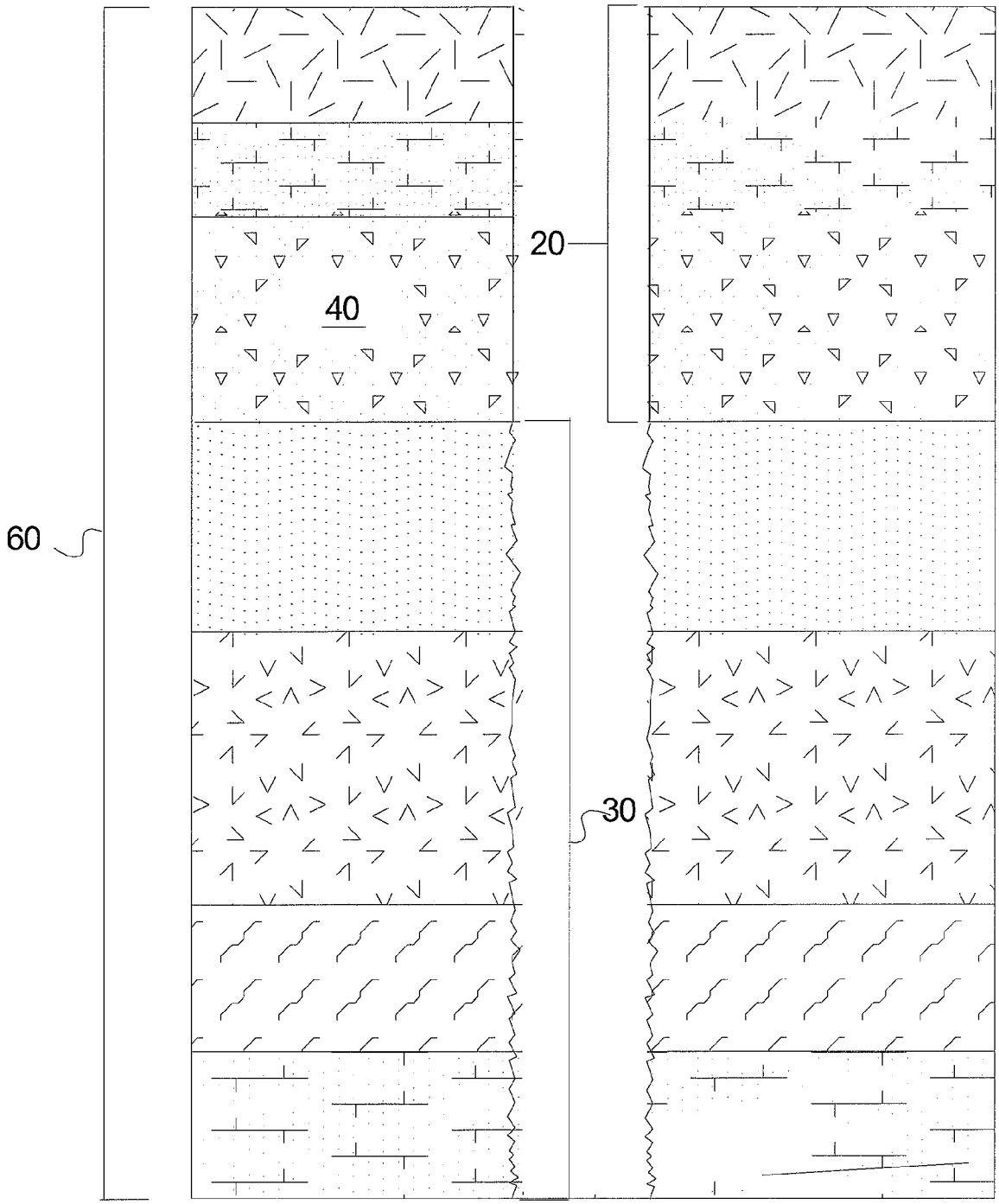
FIG. 2 is a cut-away side view of a typical wellbore, penetrating geological strata.

FIG. 2 illustrates a typical well bore 60 in geologic strata 40. The upper portion of the hole is lined with casing 20, while the lower portion of the hole is defined by uncased sidewall 30.

Figure 3:
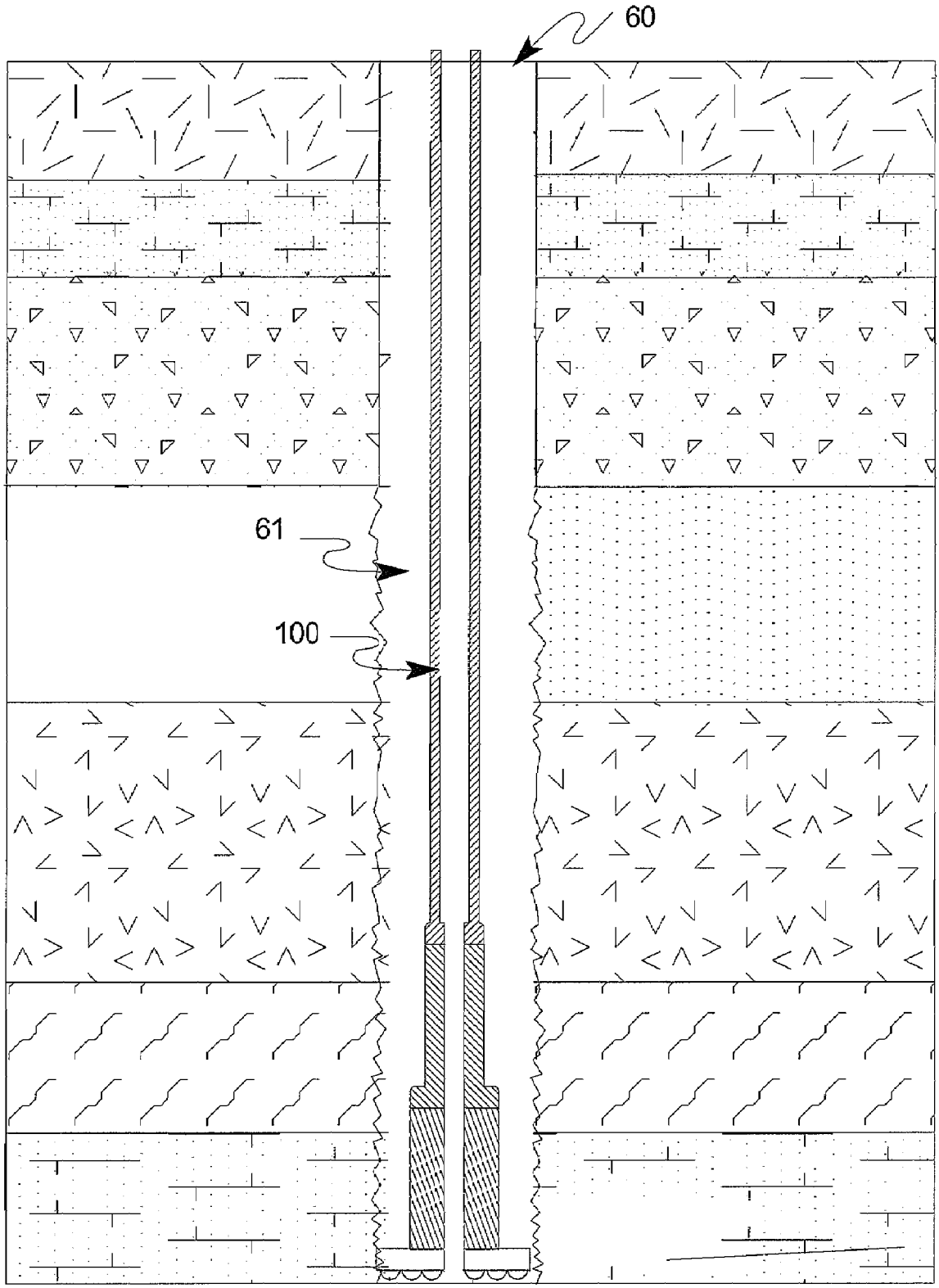
FIG. 3 is a cut-away side view of a typical wellbore penetrating geological strata showing a cross-sectional side view of the drillstring combination 100, including bottom hole assembly 120, inserted into the wellbore.

FIG. 3 illustrates a drillstring combination 100 situated in a typical well bore 60. Well bore annulus 61 is the annular space created between drillstring combination 100 and well bore 60.

Figure 4:
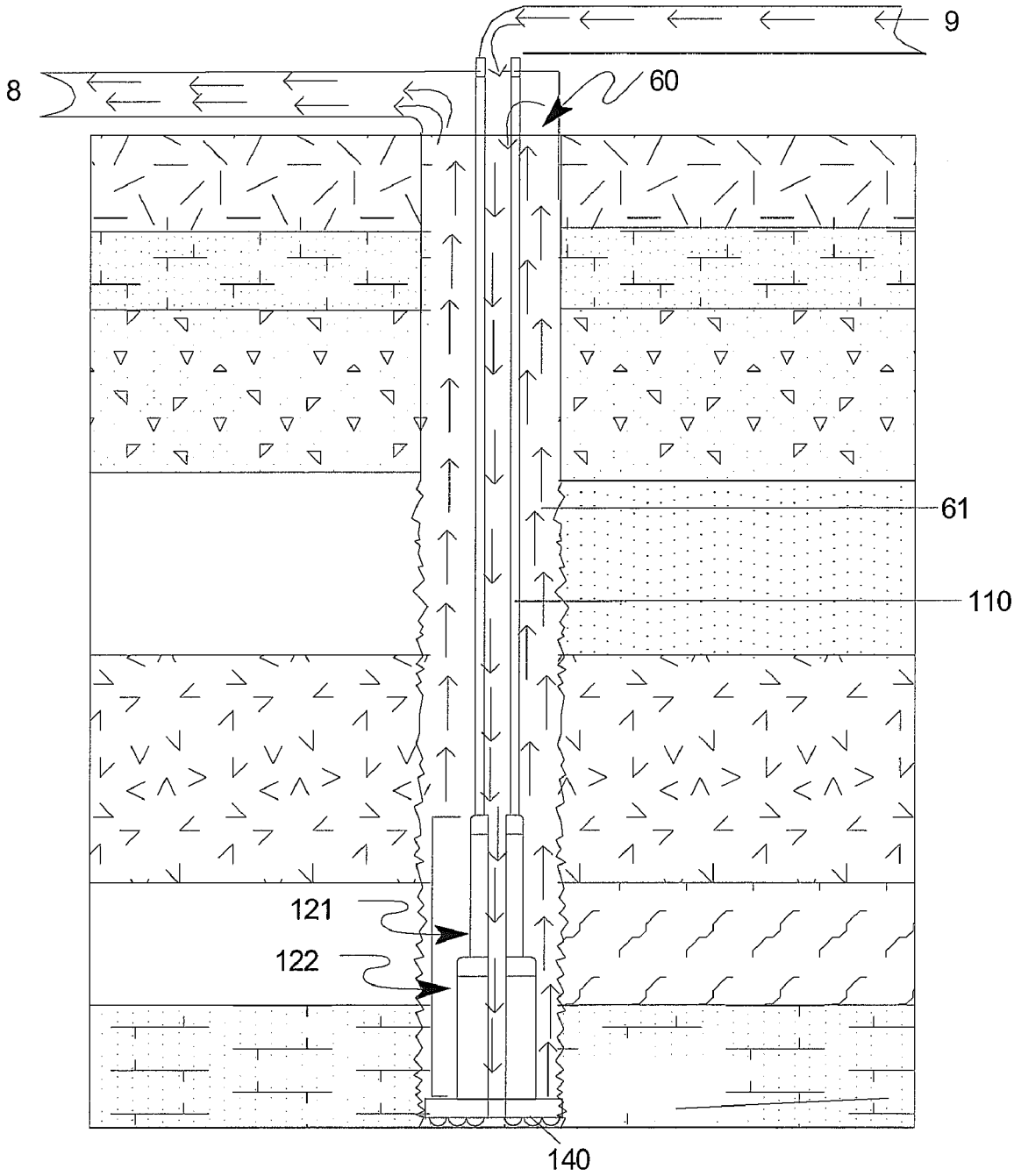
FIG. 4 is a cut-away side view of FIG. 3, with arrows showing typical direction of flow of pneumatic fluid.

FIG. 4 illustrates the connection of pneumatic inlet piping 9 to one end of drillstring combination 100. Typically, pneumatic fluid is pumped through pneumatic inlet piping 9 into the passageway of drillpipe 10 and through bottom hole assembly 120 to drill bit 140, as shown by the arrows representing pneumatic flow. The pneumatic fluid exits drill bit 140 into well bore 60 and rises up through well bore annulus 61. Blooie line 8 is connected to the well bore annulus 61 at the surface end of well bore 60. The pneumatic fluid exits well bore 60 and is retrieved by blooie line 8.

Figure 5:
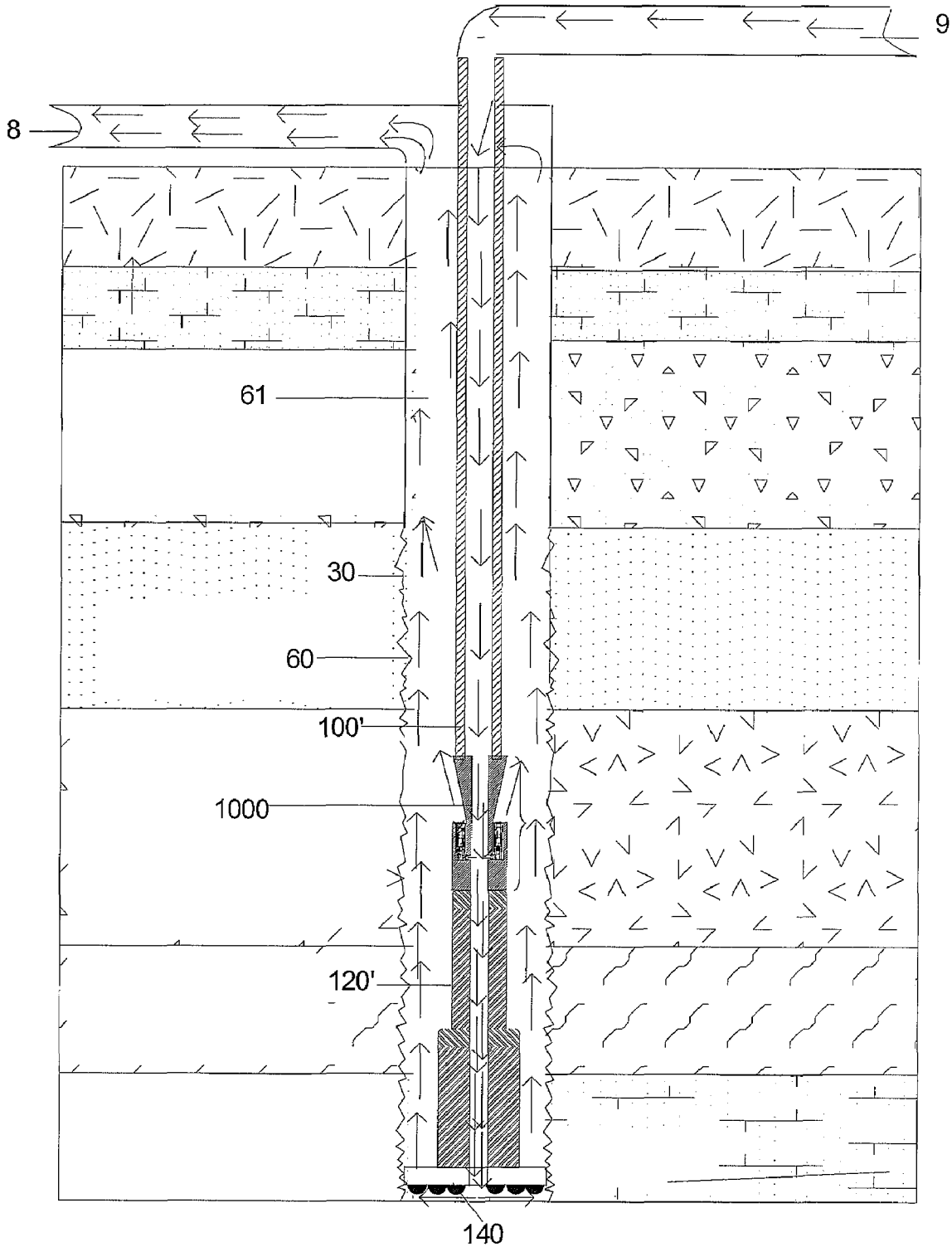
FIG. 5 is a cut-away side view of a typical wellbore penetrating geological strata showing a cross-sectional side view of the drillstring combination 100, including bottom hole assembly 120 and the Down Hole Air Diverter 1000 of the present invention, inserted into the wellbore.

FIG. 5 illustrates a drillstring combination 100' using down hole air diverter 1000 of the present invention. Down hole air diverter 1000 may be made from a piece of drillpipe, a drill collar stabilizer, or any sub which has room to contain valve assembly 1100 (illustrated in FIGS. 8 and 10). A plurality of down hole air diverters 1000 may be placed between sections of drillpipe 110 (not illustrated). Down hole air diverters 1000 may also be placed in bottom hole assembly 120', between drillpipe 110 and drill collar 121 or even between drill collars 121 or drill collars 122.

As will be better illustrated in FIG. 8, down hole air diverter 1000 releases pneumatic fluid from the passageway of drillstring combination 100' into wellbore annulus 61. Thus, some of the pneumatic fluid does not go through the entire bottom hole assembly 120', through drill bit 140, into well bore 60 and up well bore annulus 61. Rather, that portion of the pneumatic fluid enters well bore annulus 61 at the location of down hole air diverter 1000, avoiding the friction losses inside and outside that portion of bottom hole assembly 120' below down hole air diverter 1000. Further, the pressure gradient is changed in well bore annulus 61 in the region where pneumatic fluid is entering from down hole air diverter 1000. Uncased sidewall 30 (illustrated in FIG. 2) is subject to unwanted erosion due to excess pneumatic flow exiting drill bit 140. The use of down hole air diverter 1000 reduces excess pneumatic flow and substantially reduces the potential for erosion of uncased sidewall 30. Futhermore, the pneumatic flow exiting down hole air diverter 1000 into wellbore annulus 61 is used to create additional lift further up well bore 60.

Figure 6:
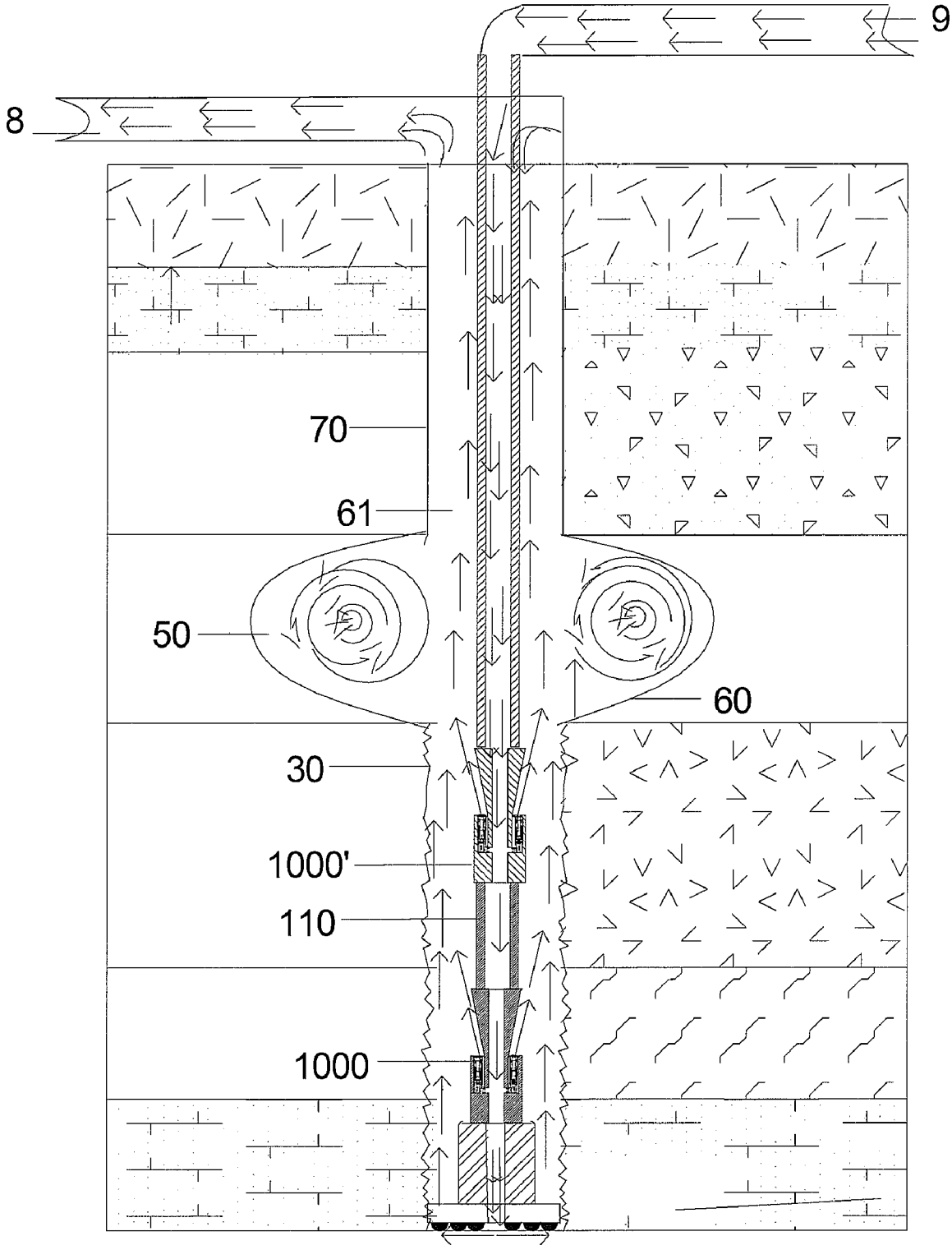
FIG. 6 is a cut-away side view of FIG. 5, additionally showing a washout zone 50 in a geologic formation.

FIG. 6 illustrates a second down hole air diverter 1000' being used to more effectively control the pressure gradient of well bore 60. Erosion occurred in uncased sidewall 30, creating washout zone 50. Washout zone 50 may have been caused by a reduction in diameter of well bore 60 beneath casing 70, or by a significantly soft formation, where first down hole diverter 1000 could not sufficiently prevent damage to well bore 60. In such a situation, down hole air diverter 1000' is positioned along drill pipe 110, preferably at a depth underneath the bottom of washout zone 50. Washout zone 50 effectively creates an increase in volume of wellbore annulus 61. The pneumatic flow through wellbore annulus 61 would typically decrease in velocity as it passes through washout zone 50. This would cause carried fluids and cuttings to deposit in the area of washout zone 50, creating unstable flow conditions, threatening to block well bore 60. Down hole air diverter 1000' provides additional pneumatic fluid into wellbore annulus 61 to increase the velocity of pneumatic flow through washout zone 50, preventing the deposit of fluids and cuttings.

FIG. 7 illustrates down hole air diverter 1000. Valve plate cover 1010 is affixed on diverter sub 1001 and is used to protect valve assembly 1100 (not shown in this FIG. 7, illustrated in FIG. 8). Diverter sub 1001 may be constructed from a drillcollar sub, a roller reamer, or stabilizer, housing a plurality, preferably two, valve assemblies 1100. Diverter sub 1001 has threadable attachment means 1005 on each end to allow attachment to drillpipe or drill collars. FIG. 7A also additionally shows, for clarity, a side view of valve plate cover 1010.

FIG. 8 illustrates down hole air diverter 1000 with a plurality of valve assemblies 1100 and valve plate cover 1010. The diverter sub 1001 has a plurality of openings 1002 which intersect inner surface 1003 and central passageway 1004 of diverter sub 1001. Openings 1002 extend perpendicularly outward from central passageway 1004 to outer surface 1006 of diverter sub 1001. Openings 1002 are threaded to threadably receive valve assembly 1100. Outer surface 1006 is shaped so as to fittably receive valve assembly 1100. Valve plate cover 1010 is shaped to fit over valve assembly 1100 and affix to diverter sub 1001, thereby immovably securing valve assembly 1100 in place at the base of opening 1002 of outer surface 1006 of diverter sub 1001. For clarity, valve assembly 1100 and valve plate cover 1010 are shown at only one opening 1002. Valve assembly 1100 is aligned almost parallel to the well bore (as illustrated in FIG. 5). From the top of valve assembly 1100, outer surface 1006 of diverter 1001 has a taper of approximately two degrees (2°) until the maximum diameter of diverter sub 1001 is reached. This shallow angle of taper is found to prevent sub damage due to erosion from the high velocities created when the pneumatic fluid exits nozzle tip 1700 (illustrated in detail in FIG. 10 and FIG. 16). This angle of diversion also prevents erosion of well bore 60 from the high velocity exit of the pneumatic fluid at nozzle tip 1700. This high velocity is effectively contained within the taper region of the outer surface 1006. Nozzle tip 1700 (illustrated in FIG. 10) is a sonic nozzle which is specifically sized, depending on the pneumatic pressure and volume requirements and the specific configuration of drill string combination 100. Valve assemblies 1100 are preferably made of stainless steel to reduce wear caused by the pneumatic fluids and surface injected liquids which may pass through. Valve assembly 1100 is approximately thirteen inches (13") long.

Figure 9:
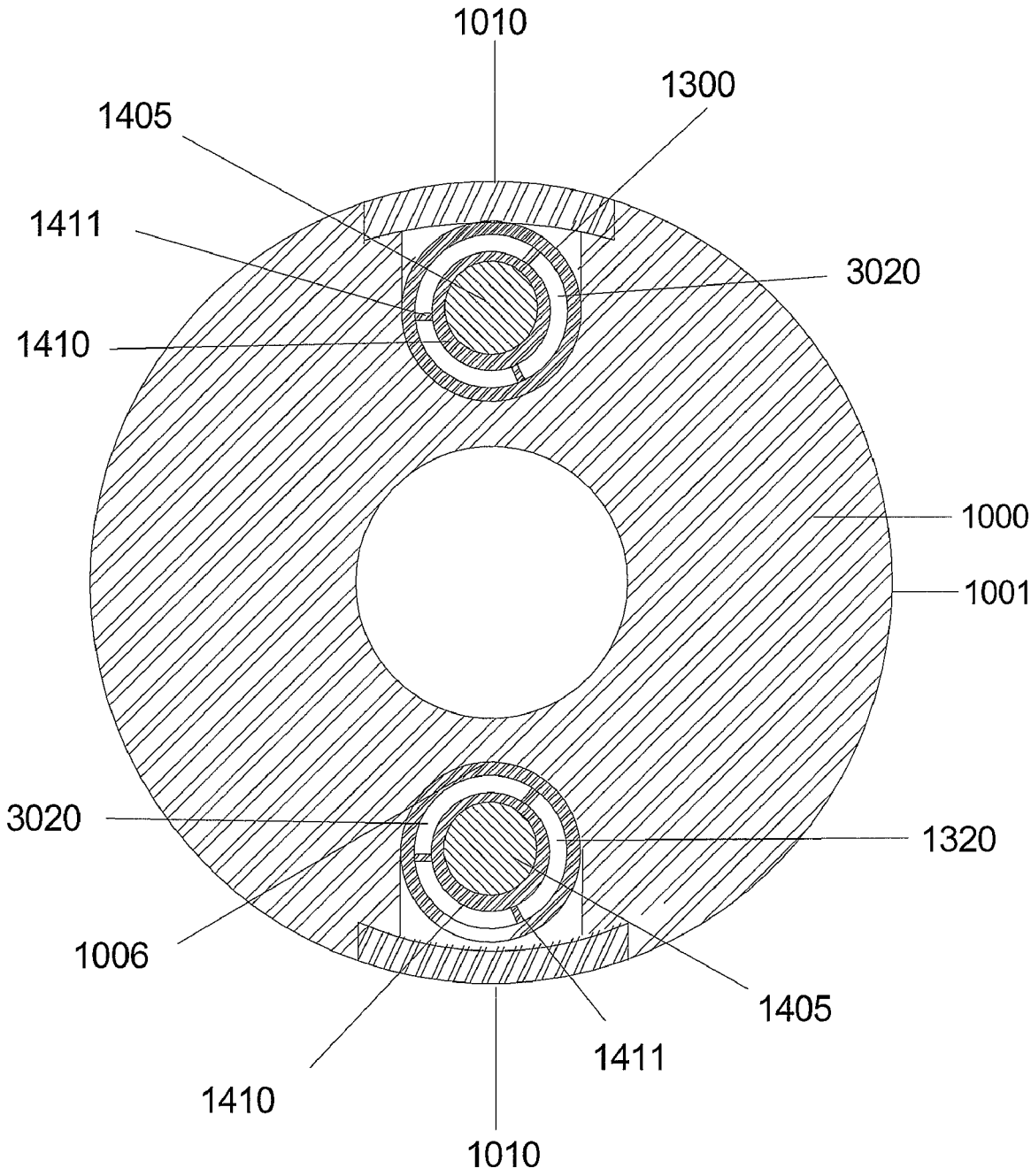
FIG. 9 is a plan cross section view of the Down Hole Air Diverter 1000 of the present invention, whose location is identified by horizontal cross section b-b' in FIG. 7.

FIG. 9 illustrates a cross section view of down hole air diverter 1000. Valve plate cover 1010 is affixed to diverter sub 1001, a cylindrical recess space within outer surface 1006 to hold valve assembly 1100. In this cross sectional view, upper valve body 1320 of valve assembly 1100 is held in place within said cylindrical recess space of outer surface 1006 by valve plate cover 1010. Protrusions 1411 from piston sleeve 1410 hold piston sleeve 1410 axially within upper valve body 1320. Valve passageway 3020 is created from the annular region between piston sleeve 1410 and upper valve body 1320 in this cross section. Upper piston 1405 is contained axially within piston sleeve 1410.

Figure 10:
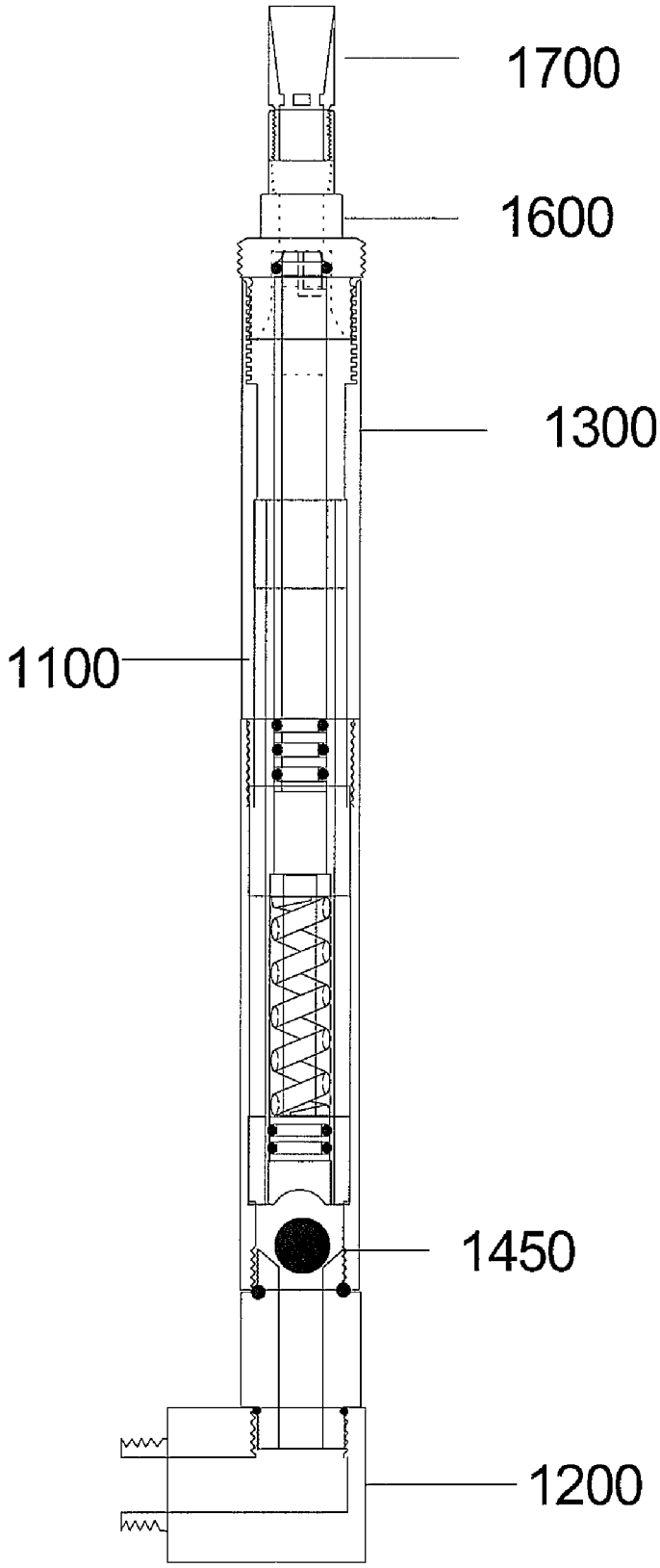
FIG. 10 is a side cross section view of valve assembly 1100 of the present invention.

FIG. 10 illustrates a side cross-section view of valve assembly 1100. Entrance port assembly 1200 is threadably attached to valve body assembly 1300. Entrance port assembly 1200, along with previously described inner surface 1003, serve as the diverter's first opening, in communication with central passageway 1004. Valve body assembly 1300 is threadably attached to exit nozzle 1600. Exit nozzle 1600 is threadably attached to nozzle tip 1700. Exit nozzle 1600 and nozzle tip 1700 serve as the diverter's second opening, in communication with well bore annulus 61. Check ball 1450 rests upon check ball seat 1230 (illustrated in FIG. 14) of entrance port assembly 1200, located valve body assembly 1300.

Figure 11:
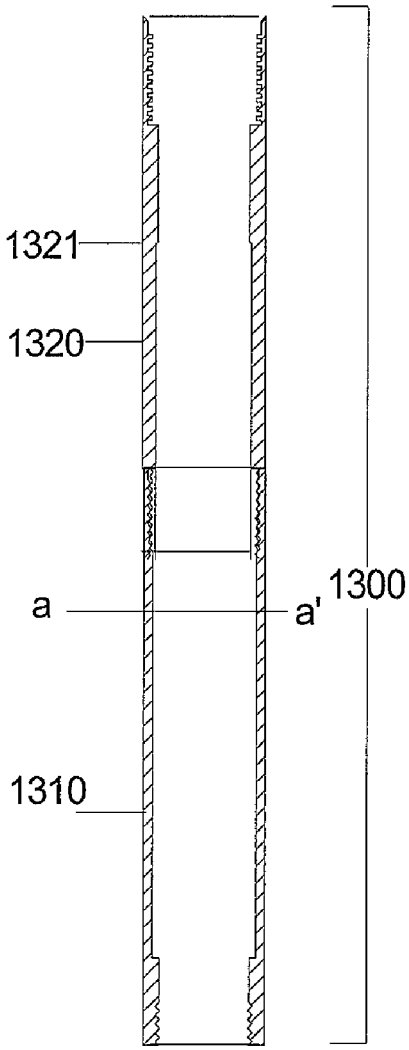
FIG. 11 is a side cross section view of the valve body assembly 1300 of valve assembly 1100 illustrated in FIG. 10 and further identifying the location of horizontal cross section a-a'.

FIG. 11 shows valve body assembly 1300, which comprises a tubular member lower valve body 1310 with attachment means to a second tubular member upper valve body 1320. The inner surface of a first end of lower valve body 1310 is threaded to threadably receive entrance port assembly 1200 (illustrated in FIG. 14), while a second end of lower valve body 1310 is threadably attached to a first end of upper valve body 1320. The inner surface of a second end of upper valve body 1320 is threaded to threadably receive exit nozzle 1600 (illustrated in FIG. 15). The inner diameter of the first end of lower valve body 1310 forms a lower sleeve seat 1311 which is less than the outer diameter of the protrusions of piston-sleeve assembly 1400 (illustrated in FIG. 12A), creating a space between piston-sleeve assembly 1400 and check ball seat 1230 (illustrated in FIG. 14). The inner diameter of the second end of upper valve body 1320 forms an upper sleeve seat 1321 which is less than the outer diameter of the protrusions of piston-sleeve assembly 1400 (illustrated in FIG. 12A).

Figure 12A:
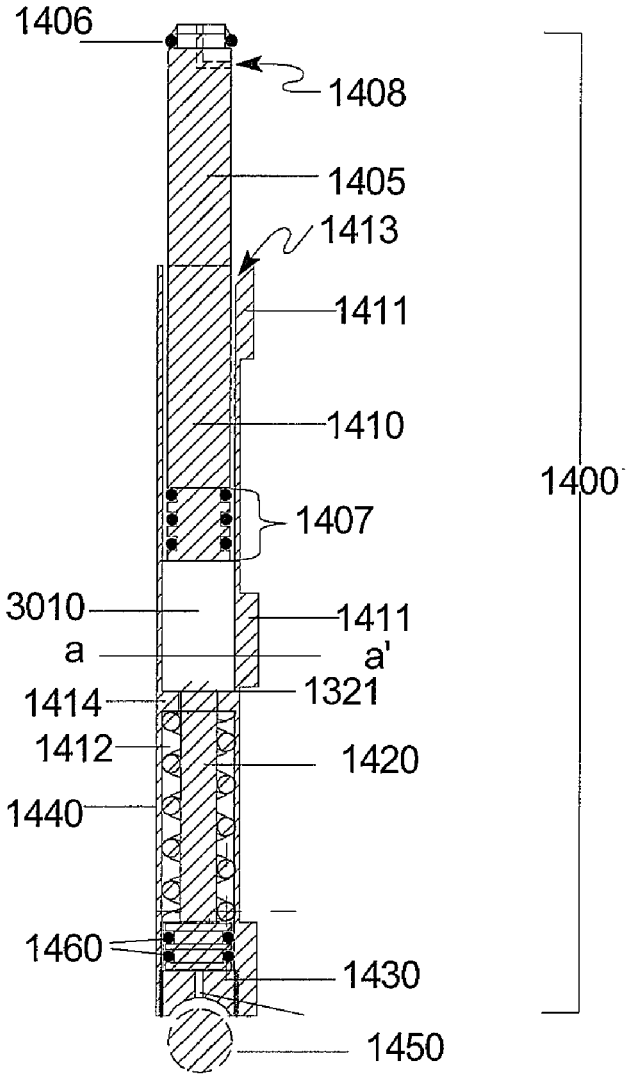
FIG. 12A is a side cross section view of the piston-sleeve assembly 1400 of valve assembly 1100 illustrated in FIG. 10 and further identifying the location of horizontal cross section a-a'.

FIG. 12A shows piston-sleeve assembly 1400. Piston sleeve 1410 is an axially hollow tubular member having a lower first end, a lower chamber 1412, an upper second end, an upper chamber 1413, standoff protrusions 1411, and spring seat 1414. Lower chamber 1412 is formed by the axially hollow bore starting at the lower first end of piston sleeve 1410 and progressing in the longitudinal direction towards the upper second end of piston sleeve 1410 until the diameter of the axially hollow bore decreases in diameter, thereby forming the lower end of spring seat 1414. Upper chamber 1413 is formed by the axially hollow bore starting at the upper second end of piston sleeve 1410 and progressing in the longitudinal direction towards the lower first end of piston sleeve 1410 until the diameter of the axially hollow bore decreases in diameter, thereby forming the upper end of spring seat 1414. Preferably, the diameter of upper chamber 1413 is smaller than the diameter of lower chamber 1412. Standoff protrusions 1411 are placed at various locations on the outside wall of piston sleeve 1410.

A first end of lower piston 1420 is shaped to conform to the inner surface of lower chamber 1412 of piston sleeve 1410 while a second end of lower piston 1420 is significantly smaller diameter, forming a shaft which may freely enter the axial bore of spring seat 1414 of piston sleeve 1410. Lower piston o-rings 1460 are fitted around the outer diameter of lower piston 1420, adjacent to the first end of lower piston 1420, providing a pneumatic seal between the first end and second end of lower piston 1420. Lower piston compression spring 1440 is of helical design with an outside diameter less than the inner diameter of lower chamber 1412 of piston sleeve 1410 and an inner diameter greater than the diameter of the second end of lower piston 1420. Lower piston compression spring 1440 is placed on the shaft formed by the second end of lower piston 1420.

The second end of lower piston 1420 is inserted into lower chamber 1412 at the lower first end of piston sleeve 1410. A first end of lower piston retainer 1430 threadably attaches to the lower first end of piston sleeve 1410 and may be attached upon applying pressure on the first end of lower piston 1420 to compress lower piston spring 1440 against spring seat 1414, forcing the second end of lower piston 1420 to enter upper chamber 1413 through the axial bore of spring seat 1414.

The first end of lower piston retainer 1430 has an axial bore shaped to receive lower piston 1420, a second end of lower piston retainer 1430 has an axial bore shaped to receive check ball 1450, and an axial bore of smaller diameter communicating the first end of lower piston retainer 1430 with the second end of lower piston retainer 1430.

Upper piston 1405 is generally a solid cylinder of length longer than upper chamber 1413 of piston sleeve 1410. The first end of upper piston 1405 is shaped to conform to the inner surface of upper chamber 1413 of piston sleeve 1410. Upper piston bottom rings 1407 are fitted around the outer diameter of upper piston 1405, adjacent to the first end of lower piston 1405, providing a pneumatic seal between the first end and second end of upper piston 1405 when upper piston 1405 is inserted into upper chamber 1413 of piston sleeve 1410. The outer diameter of a second end of upper piston 1405 is fitted with upper piston top o-ring 1406. Bleeder 1408 creates a pneumatic passageway between the top of the second end of upper piston 1405, located on one side of upper piston top o-ring 1406, and the outer side wall of upper piston 1405, located on the other side of upper piston top o-ring 1406.

The first end of upper piston 1405 is inserted into upper chamber 1413 at the upper second end of piston sleeve 1410. Pressure chamber 3010 is formed between lower piston o-rings 1460 of lower piston 1420 and upper piston bottom rings 1407 of upper piston 1405. In an alternate embodiment, a compression spring (not illustrated) may be inserted into pressure chamber 3010 to supplement the biasing effect of pressure chamber 3010.

As can be seen from FIG. 11 and FIG. 12A, the first end of lower piston retainer 1430 of piston-sleeve assembly 1400 may be inserted through the second end of lower valve body 1310 until it reaches lower sleeve seat 1311. The second end of upper piston 1405, representing the opposite end of piston-sleeve assembly 1400, may be inserted through the first end of upper valve body 1320. The second end of lower valve body 1310 is threadably attached to the first end of upper valve body 1320, thereby affixing upper second end of piston sleeve 1410 to upper sleeve seat 1321.

Figure 12B:
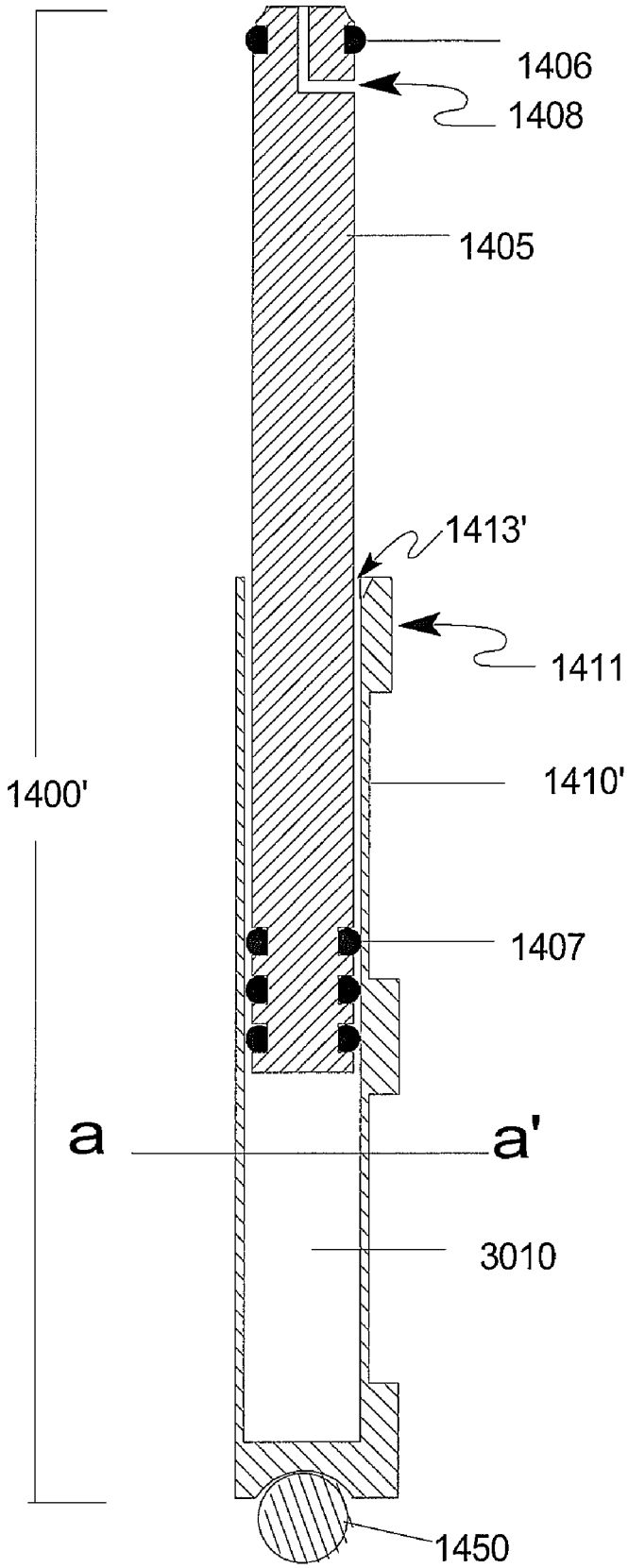
FIG. 12B is a side cross section view of an alternate embodiment of the piston-sleeve assembly 1400' of valve assembly 1100 illustrated in FIG. 10 and further identifying the location of horizontal cross section a-a'.

FIG. 12B shows an alternate embodiment of piston-sleeve assembly 1400'. Piston sleeve 1410' is a cylindrical member having a lower first end, an upper second end having an axially hollow tubular bore forming a chamber 1413', and standoff protrusions 1411. Standoff protrusions 1411 are placed at various locations on the outside wall of piston sleeve 1410'.

The first end of piston sleeve 1410' has an axial bore shaped to receive check ball 1450, which is not in communication with chamber 1413'.

Upper piston 1405 is generally a solid cylinder of length longer than chamber 1413' of piston sleeve 1410'. The first end of upper piston 1405 is shaped to conform to the inner surface of chamber 1413' of piston sleeve 1410'. Upper piston bottom rings 1407 are fitted around the outer diameter of upper piston 1405, adjacent to the first end of lower piston 1405, providing a pneumatic seal between the first end and second end of upper piston 1405 when upper piston 1405 is inserted into chamber 1413' of piston sleeve 1410'. The outer diameter of a second end of upper piston 1405 is fitted with upper piston top o-ring 1406. Bleeder 1408 creates a pneumatic passageway between the top of the second end of upper piston 1405, located on one side of upper piston top o-ring 1406, and the outer side wall of upper piston 1405, located on the other side of upper piston top o-ring 1406.

The first end of upper piston 1405 is inserted into chamber 1413' at the upper second end of piston sleeve 1410'. Pressure chamber 3010 is formed between bottom of chamber 1413' and upper piston bottom rings 1407 of upper piston 1405.

Figure 13:
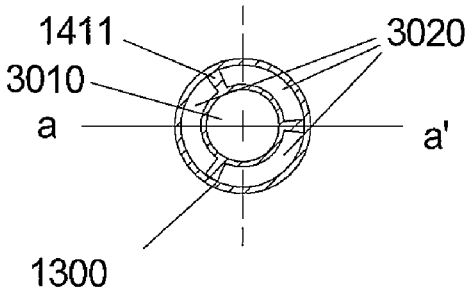
FIG. 13 is a plan cross section view of piston sleeve 1410 of piston-sleeve assembly 1400, whose location is identified by horizontal cross section a-a' of FIG. 12A.

FIG. 13 illustrates a cross section view of piston sleeve 1410 showing a plurality of standoff protrusions 1411 located at various locations on the outer surface of piston sleeve 1410. Protrusions 1411 seat piston sleeve 1410 axially into lower valve body 1310, thereby forming piston sleeve annular passageway 3020. Pressure chamber 3010, being formed by the inside axial bore of piston sleeve 1410, is also shown at this cross section location.

Figure 14:
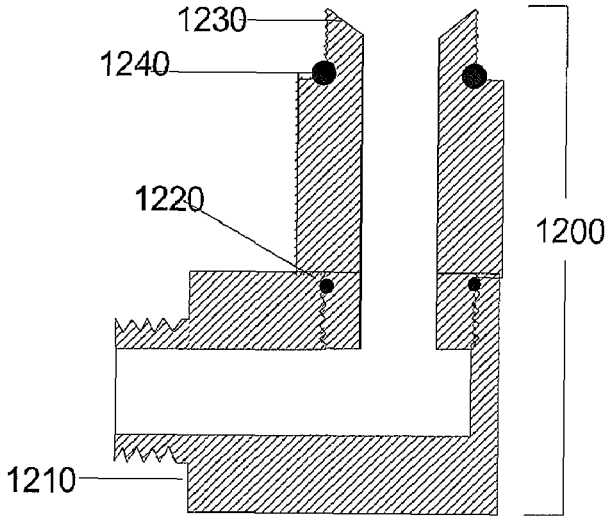
FIG. 14 is a side cross section view of entrance port assembly 1200 of valve assembly 1100 of FIG. 10.

FIG. 14 illustrates entrance port assembly 1200. Entrance port hex nut 1210 comprises a male threaded end and a female threaded end with a central passageway in communication between the two said ends. A male threaded first end of check ball seat 1230 is threadably attached to the female threaded end of entrance port hex nut 1210. Entrance port o-ring 1220 is affixed at the base of the male threaded first end of check ball seat 1230 so as to provide an adequate pneumatic seal A central passageway within check ball seat 1230 is in communication with the central passageway of entrance port hex nut 1210. A second end of check ball seat 1230 is shaped so as to have an outside diameter less than the outside diameter of the main body portion of check ball seat 1230. The inner surface of said second end of check ball seat 1230 is further shaped to conformably receive check ball 1450 (illustrated in FIG. 12A). Valve body o-ring 1240 is affixed to the outside body of check ball seat 1230 at the location where the outside diameter of check ball seat 1230 changes from the main body diameter to the second end diameter. The outer surface of the second end of check ball seat 1230 is threaded to conform to the inner surface threading of lower valve body 1310 (illustrated in FIG. 11).

Figure 15:
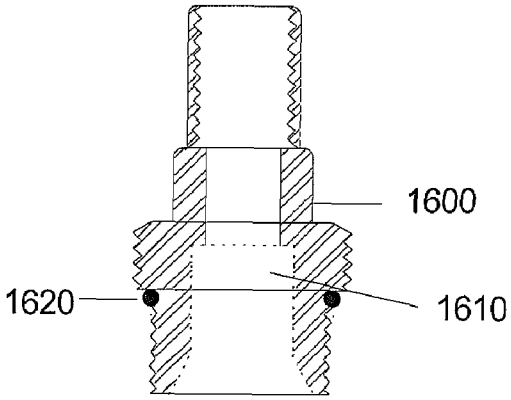
FIG. 15 is a schematic side view of exit nozzle 1600 of valve assembly 1100 of FIG. 10.

FIG. 15 illustrates exit nozzle 1600, having a central passageway along its longitudinal axis. The outer surface of the first end of exit nozzle 1600 is threaded to conform to the inner surface threading of the second end of upper valve body 1320 (illustrated in FIG. 11). Exit nozzle o-ring 1620 is affixed to the base of threading on the first end of exit nozzle 1600. Upper piston seat 1610 is formed by the inner surface of the first end of exit nozzle 1600, shaped to conform to the second end of upper piston 1405 and upper piston top o-ring 1406 (illustrated in FIG. 12A), thereby forming a first pneumatic seal. The inner surface of a second end of exit nozzle 1600 is threaded to conform to the outer surface threading of a first end of nozzle tip 1700 (illustrated in FIG. 16). The second end of exit nozzle 1600 is in communication with the first end of exit nozzle 1600 by way of the central passageway.

Figure 16:
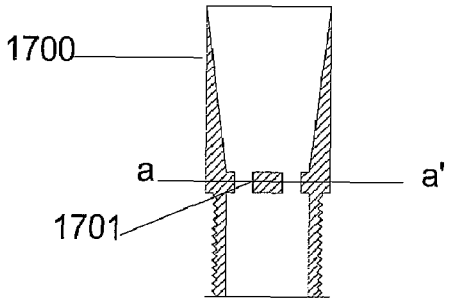
FIG. 16 is a cross section side view of nozzle tip 1700 of valve assembly 1100 of FIG. 10 and further identifying the location of horizontal cross section a-a'.

FIG. 16 illustrates nozzle tip 1700. The outer surface of the first end of nozzle tip 1700 is threaded to conform to the inner surface threading of the second end of exit nozzle 1600 (illustrated in FIG. 15). The outer body of nozzle tip 1700 is otherwise generally hexagonal in shape. Nozzle tip 1700 is generally hollow, having a first axial bore of a first inner diameter at the first end of nozzle tip 1700 and a second axial bore of slightly larger second inner diameter at the second end of nozzle tip 1700. Said first axial bore of nozzle tip 1700 is separated from said second axial bore of nozzle tip 1700 by a restriction 1701 further detailed in FIG. 17. The second inner diameter of the second axial bore varies and increases away from restriction 1701.

Figure 17:
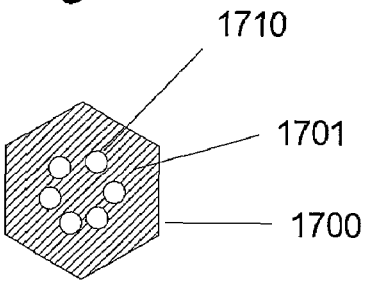
FIG. 17 is a plan cross section view of nozzle tip 1700, whose location is identified by horizontal cross section a-a' of FIG. 16.

FIG. 17 illustrates a cross section view of nozzle tip 1700 at restriction 1701. A plurality of nozzle orifices 1710 control the volume and velocity of flow between the first end of nozzle tip 1700 and the second end of nozzle tip 1700.

Figure 18:
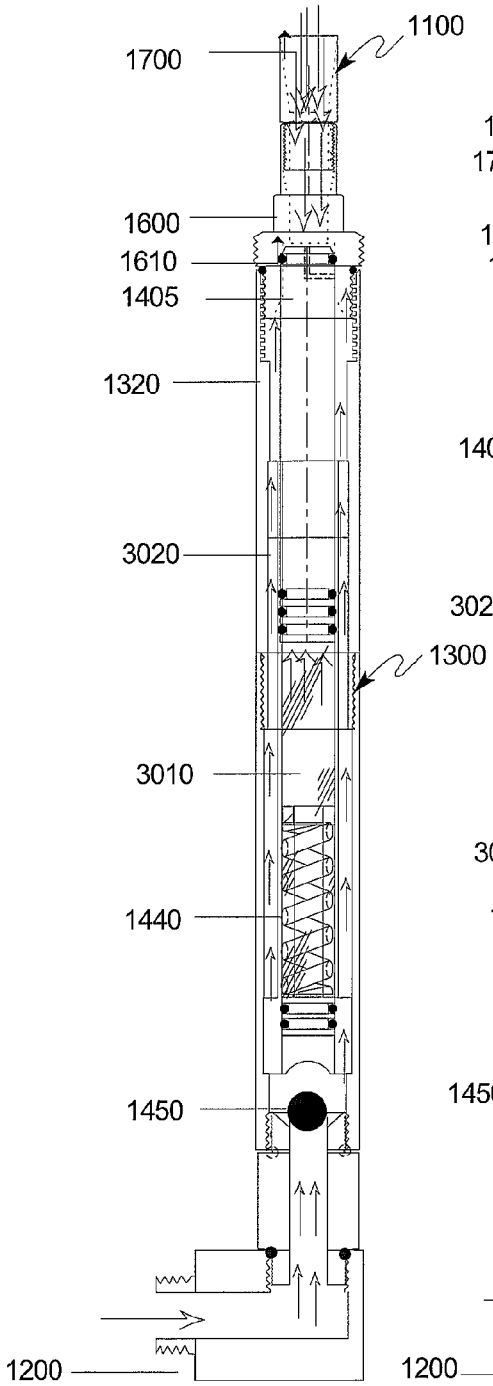
FIG. 18 is a schematic side view of valve assembly 1100 in a first closed position.

FIG. 18 shows the completed valve assembly 1100 in an initially closed position The outer surface of the first end of exit nozzle 1600 is threadably connected to the inner surface threading of the second end of upper valve body 1320 of valve body assembly 1300. This causes a downward pressure on upper piston 1405, resulting in an increase in pressure in pressure chamber 3010 and seating of the second end of upper piston 1405 into upper piston seat 1610 of the first end of exit nozzle 1600. The resulting chamber between upper piston seat 1610 and nozzle tip 1700 has an effective cross sectional area that is less than the effective cross sectional area of the chamber created by valve passageway 3020 when upper piston 1405 is unseated from upper piston seat 1610, thereby controlling the rate of pneumatic flow by configuration of exit nozzle 1600 or nozzle tip 1700.

Computer Program

FIGS. 21 through 28 illustrate the Network Analysis Module of the computer program. Data inputs are labeled D1 through D63. Computing functions are labeled F1 through F24, which are individually well known to those skilled in the art. Computation results are labeled R1 through R8.

Figure 21:
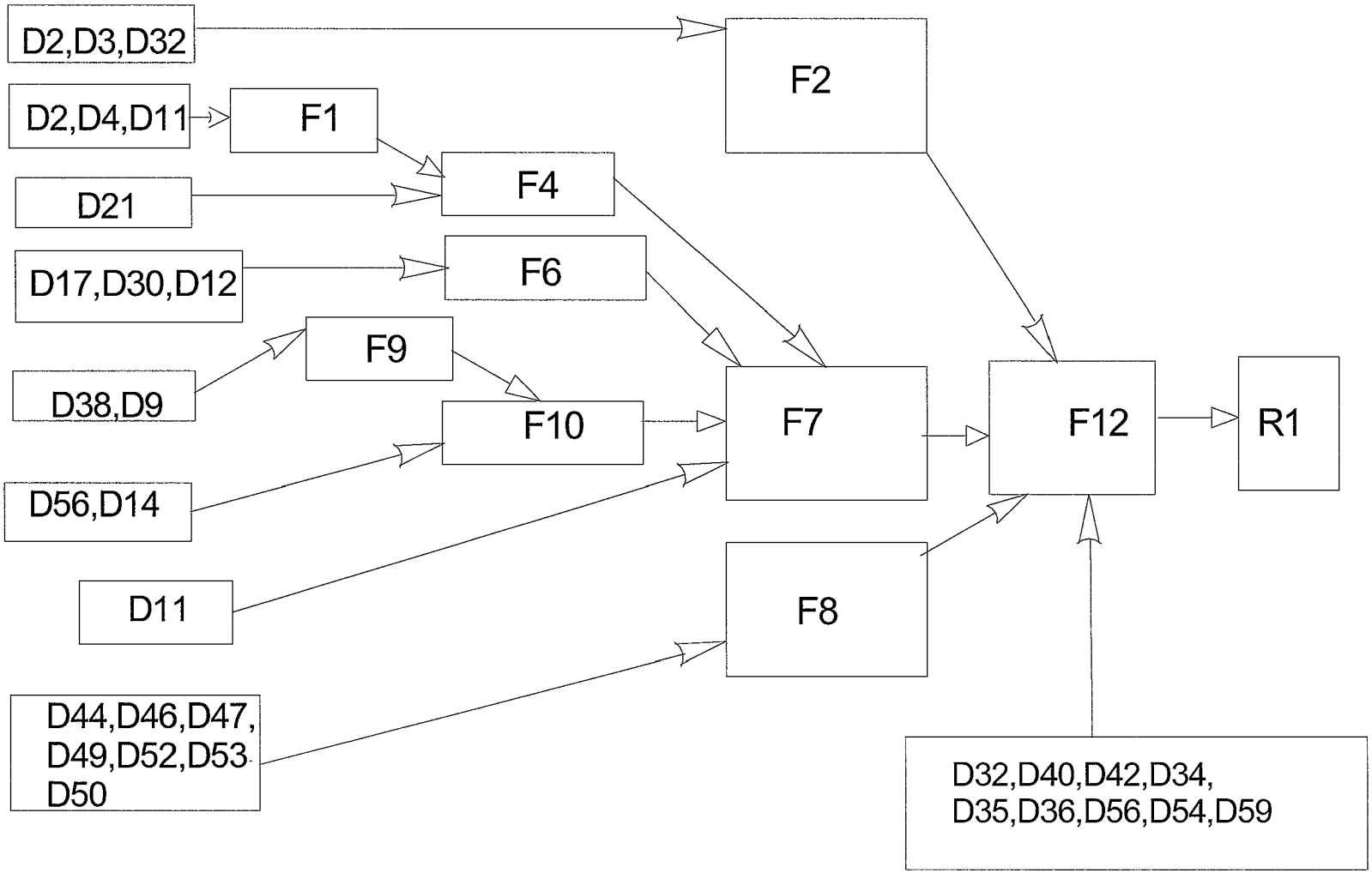
FIG. 21 is a flowchart view of the Network Analysis Module of the computer program to determine Annulus Pressure Versus Depth R1.

FIG. 21 illustrates vector computation result Annulus Pressure Versus Depth R1, calculated by computing function Annulus Pressure F12. Annulus Pressure F12 is derived by applying vector function results Average Temperature Versus Depth F2, Outside Constant A F7, Outside Constant B F8, and data inputs Open Hole TD D32, Depth of Diverter One D40, Depth of Diverter Two D42, Blooie Line Outside Diameter D34, Blooie Line Outside Diameter D35, Blooie Line Length D36, Estimated Produced Water Rate D56, Estimated Depth To Base Of Water D54, and Hole Diameter In Affected Area D59.

Average Temperature Versus Depth F2 is derived by applying data inputs Mean Surface Temperature D2, Temperature Gradient D3, and Open Hole TD D32.

Outside Constant A F7 is derived by applying vector function results Weight Rate Gas Flow F4, Weight Rate Solids Flow F6, Weight Rate Injected Fluid Flow F9, Weight Rate Produced Liquids Flow F10, and data input Gas Specific Gravity D11.

Weight Rate Gas Flow F4 is derived by applying function results Gas Density At Surface F1 and data input Actual Injected Air D21.

Gas Density At Surface F1 is derived by applying data inputs Mean Surface Temperature D2, Surface Atmospheric Pressure D4, and Gas Specific Gravity D1.

Weight Rate Solids Flow F6 is derived by applying data inputs Specific Gravity Solids D12, Bit Size D30, and Drilling Rate D17.

Weight Rate Injected Fluid Flow F9 is derived by applying data inputs Mist Or Dust Drilling Flag D9, Actual Volume Of Injection Water D38, and Specific Gravity Of Injected Fluids D13.

Weight Rate Produced Liquids Flow F10 is derived by applying function results Weight Rate Injected Fluid Flow F9, and data inputs Formation Water Production D56, and Specific Gravity Of Produced Fluids D14.

Outside Constant B F8 is derived by applying data inputs Drill Pipe Outside Diameter D44, Drill Pipe Length D46, Drill Collar 1 Outside Diameter D47, Drill Collar 1 Length D49, Drill Collar 2 Outside Diameter D50, Drill Collar 2 Length D52, and Absolute Roughness D53.

Figure 22:
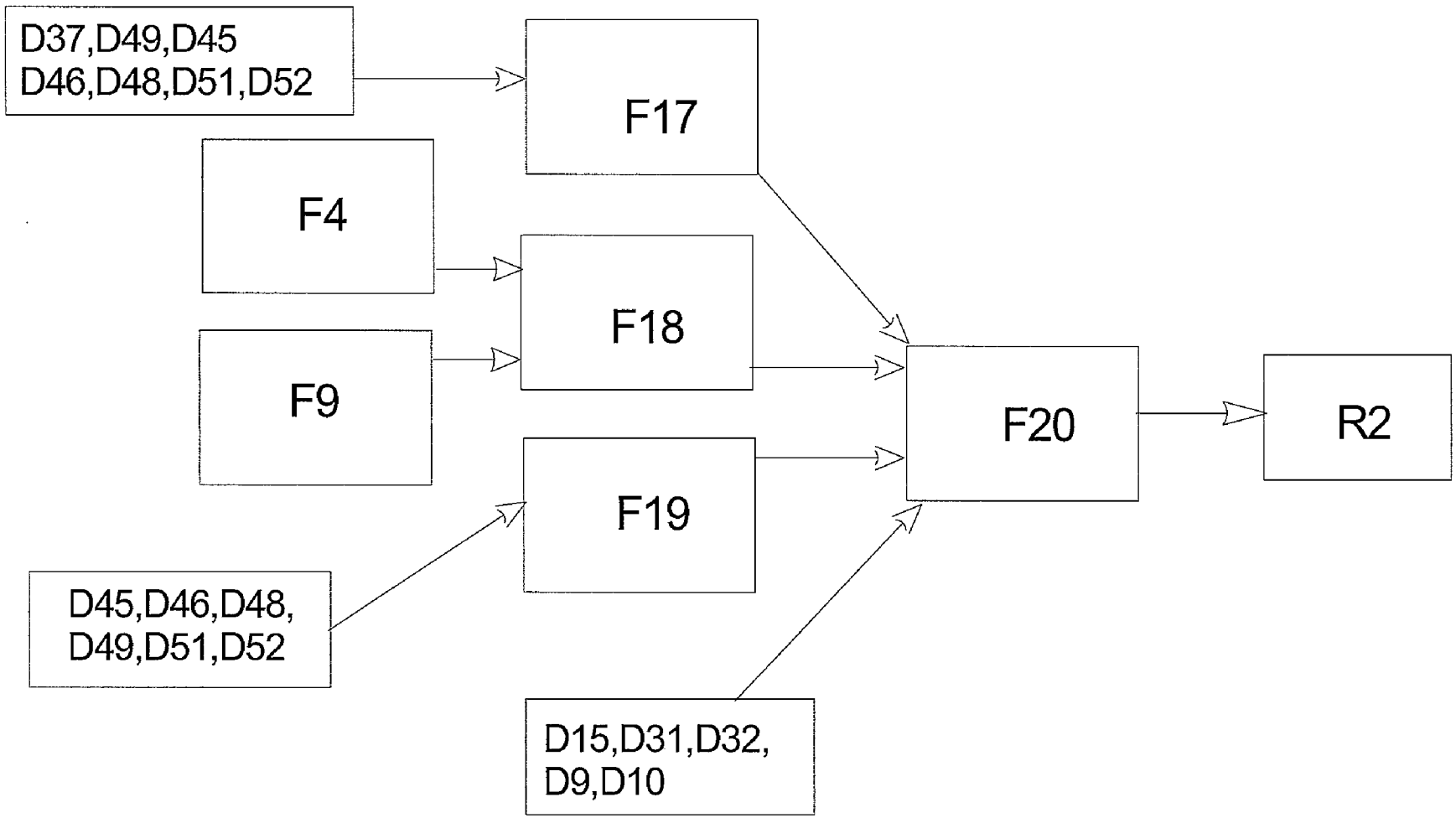
FIG. 22 is a flowchart view of the Network Analysis Module of the computer program to determine Drillpipe Pressure Versus Depth R2.

FIG. 22 illustrates vector computation result Drillpipe Pressure Versus Depth R2, calculated by computing function Drillpipe Pressure F20. Drillpipe Pressure F20 is derived by applying vector function Internal Friction Factor A F17, Internal Constant A F18, Internal Constant B F19 and data inputs Flat Bottom Bit Design Pressure D15, Bit Nozzle Orifice Inside Diameter D31, Open Hole TD D32, Mist Or Dust Drilling Flag D9, and Bit Type Flag D10.

Internal Friction Factor A F17 is derived by applying data inputs Open Hole Absolute Roughness D37, Drill Collar 1 Length D49, Drill Pipe Inside Diameter D45, Drill Pipe Length D46, Drill Collar 1 Inside Diameter D48, Drill Collar 2 Inside Diameter D51, and Drill Collar 2 Length D52.

Internal Constant A F18 is derived by applying function results Weight Rate Gas Flow F4 and Weight Rate Injected Fluid Flow F9.

Internal Constant B F19 is derived by applying function results Internal Friction Factor A F17 and data inputs Drill Pipe Inside Diameter D45, Drill Pipe Length D46, Drill Collar 1 Inside Diameter D48, Drill Collar 1 Length D49, Drill Collar 2 Inside Diameter D51, and Drill Collar 2 Length D52.

Figure 23:
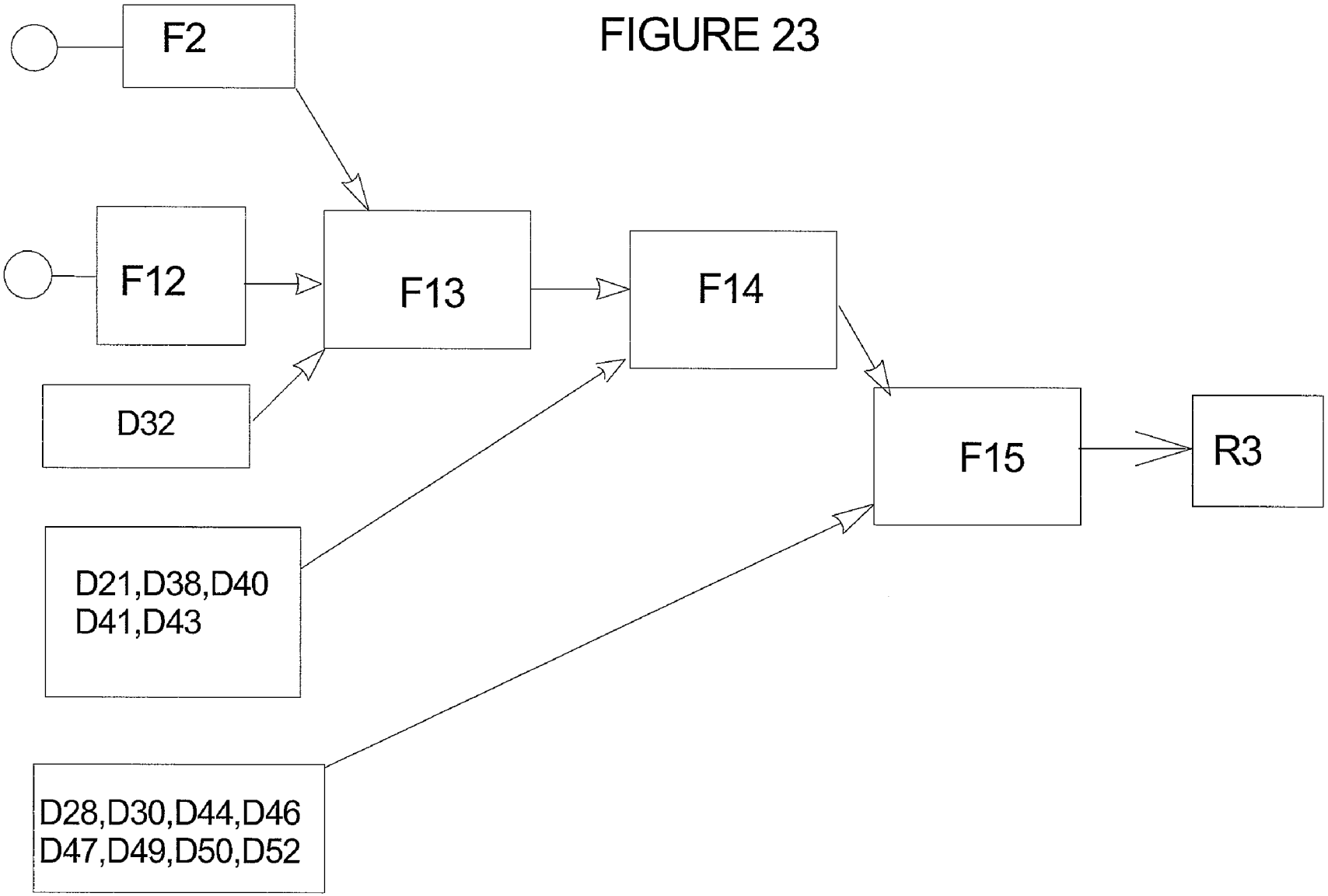
FIG. 23 is a flowchart view of the Network Analysis Module of the computer program to determine Air Velocity Versus Depth R3.

FIG. 23 illustrates vector computation result Air Velocity Versus Depth R3, calculated by computing function F15. F15 is derived by applying vector function Downhole Flowrate F14 and data inputs Bit Size D30, Casing Inside Diameter D28, Drill Pipe Outside Diameter D44, Drill Pipe Length D46, Drill Collar 1 Outside Diameter D47, Drill Collar 1 Length D49, Drill Collar 2 Outside Diameter D50, and Drill Collar 2 Length D52.

Downhole Flowrate F14 is derived by applying vector function Gas Density Downhole F13 and data inputs Actual Injected Air D21, Actual Volume Of Injection Water D38, Depth of Diverter One D40, Diverter One Diversion Volume D41, and Diverter Two Diversion Volume D43.

Gas Density Downhole F13 is derived by applying vector function Average Temperature Versus Depth F2, Annulus Pressure F12 and data input Open Hole TD D32.

Figure 24:
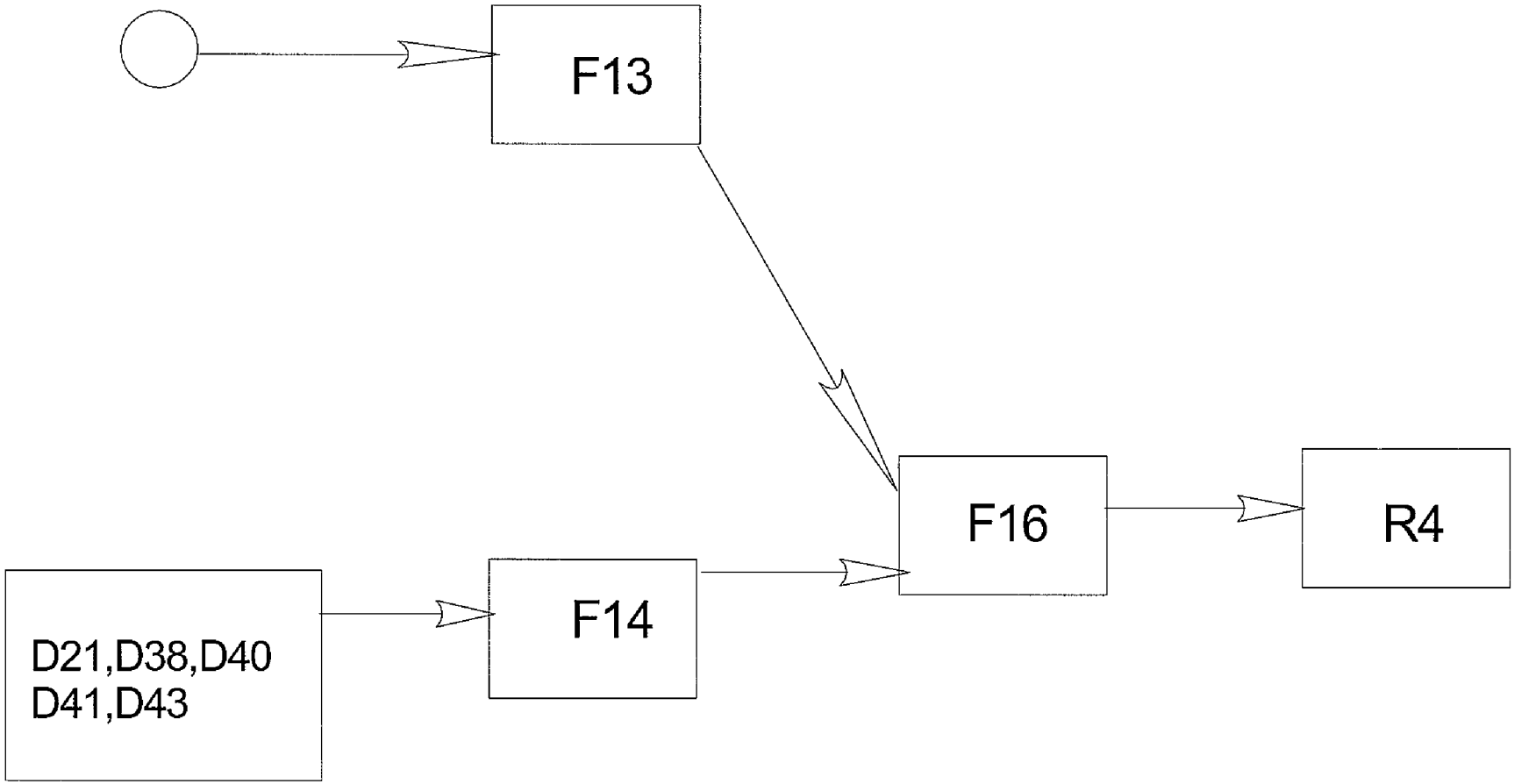
FIG. 24 is a flowchart view of the Network Analysis Module of the computer program to determine Kinetic Energy Versus Depth R4.

FIG. 24 illustrates vector computation result Kinetic Energy Versus Depth R4, calculated by computing function F16. F16 is derived by applying vector function Gas Density Downhole F13 and Downhole Flowrate F14.

Figure 25:
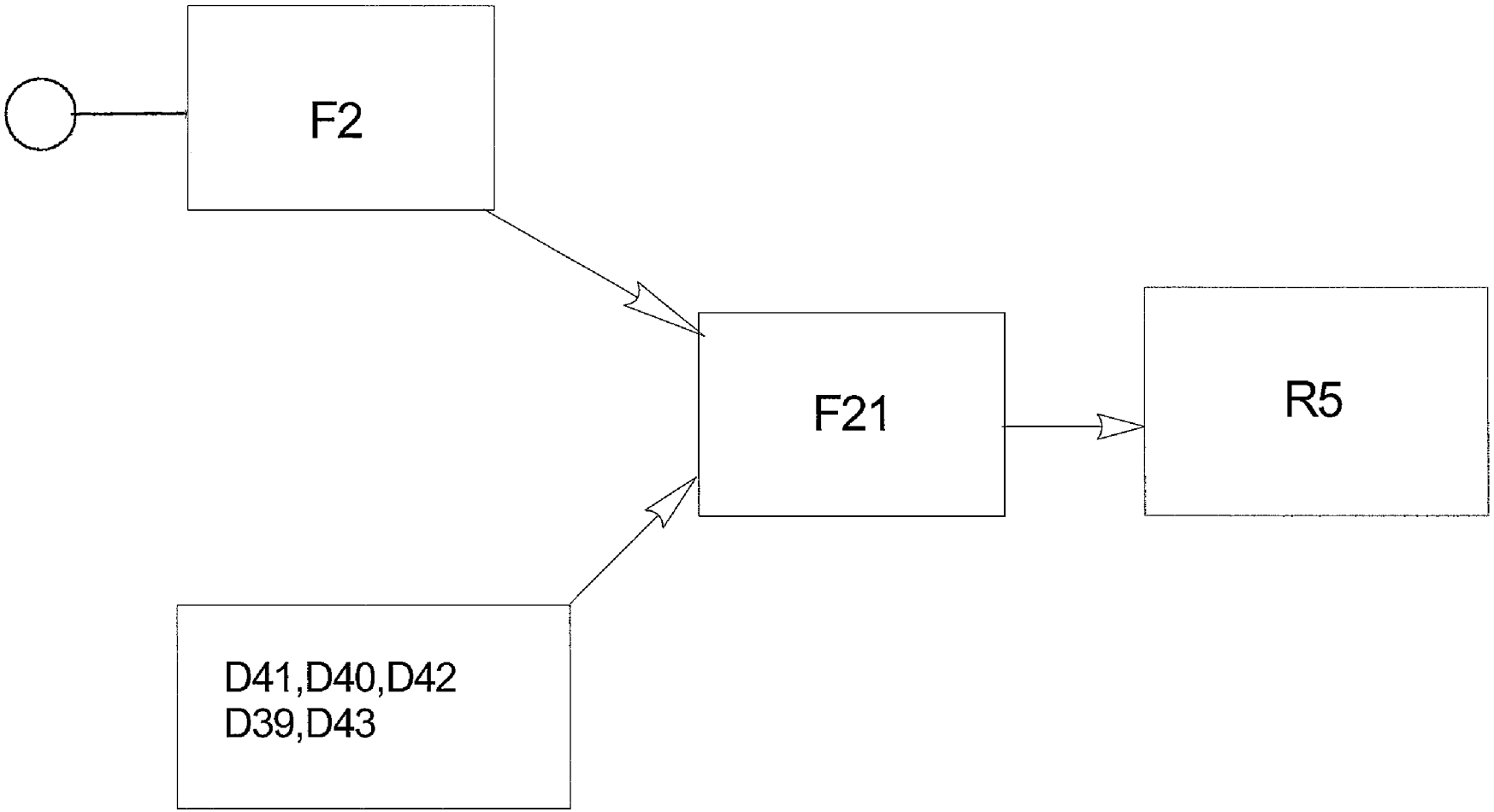
FIG. 25 is a flowchart view of the Network Analysis Module of the computer program to determine Nozzle Sizes R5.

FIG. 25 illustrates vector computation result Nozzle Size R5, calculated by computing function F21. F21 is derived by applying vector function Average Temperature Versus Depth F2 and data inputs Depth of Diverter One D40, Depth of Diverter Two D42, Number of Diverters D39, Diverter One Diversion Volume D41, and Diverter Two Diversion Volume D43.

Figure 26:
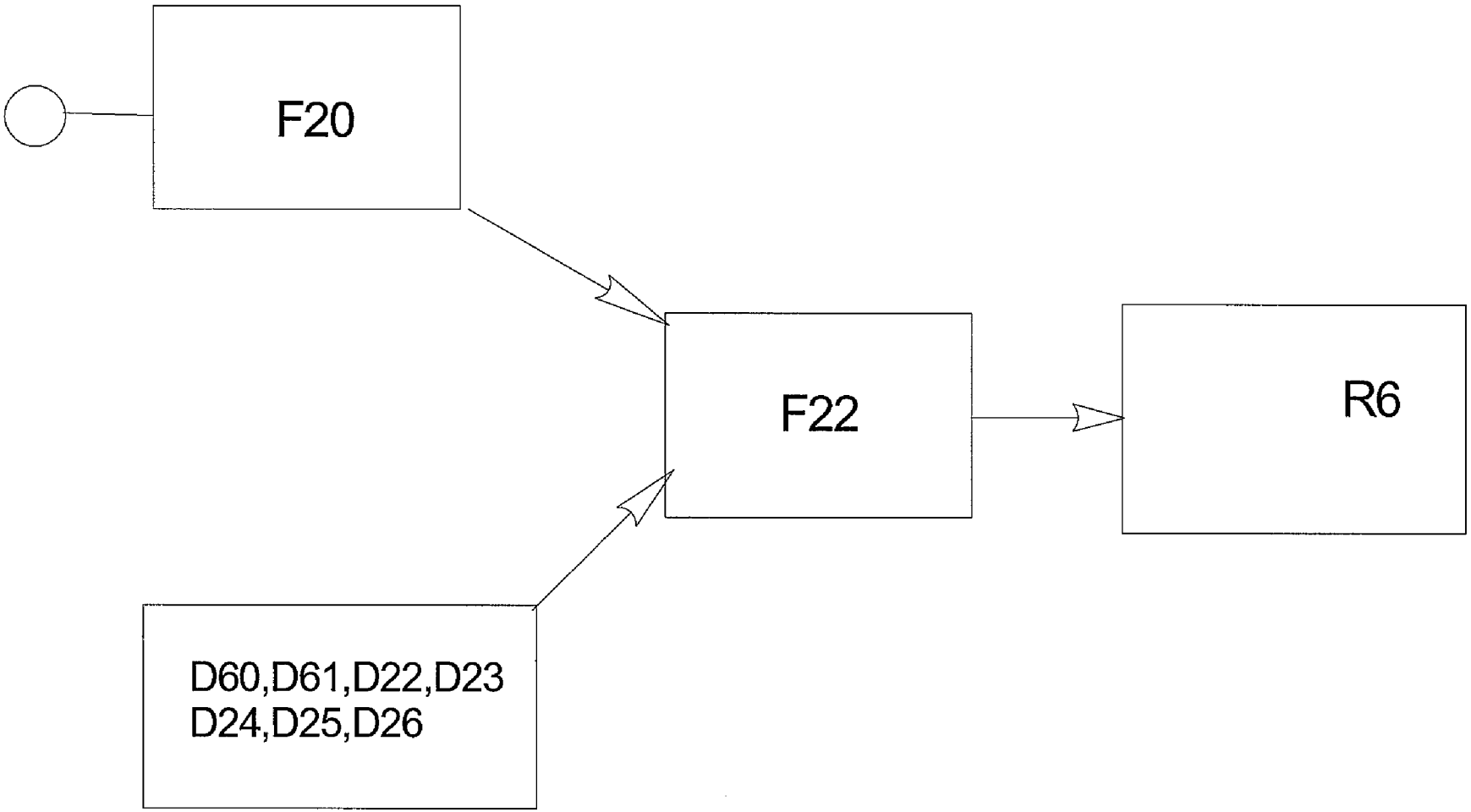
FIG. 26 is a flowchart view of the Network Analysis Module of the computer program to determine Compressor Horsepower Hours R6.

FIG. 26 illustrates computation result Compressor Horsepower Hours R6, calculated by computing function Compressor Horsepower Hours F22. Compressor Horsepower Hours F22 is derived by applying vector function Drillpipe Pressure F20, and data inputs Booster Used Flag D60, Number Of Booster Stages D61, Specific Heat of Air D22, Compressor Input Temperature D23, Compressor Output Temperature D24, Compressor Output Pressure D25, and Number of Compressor Stages D26.

Figure 27:
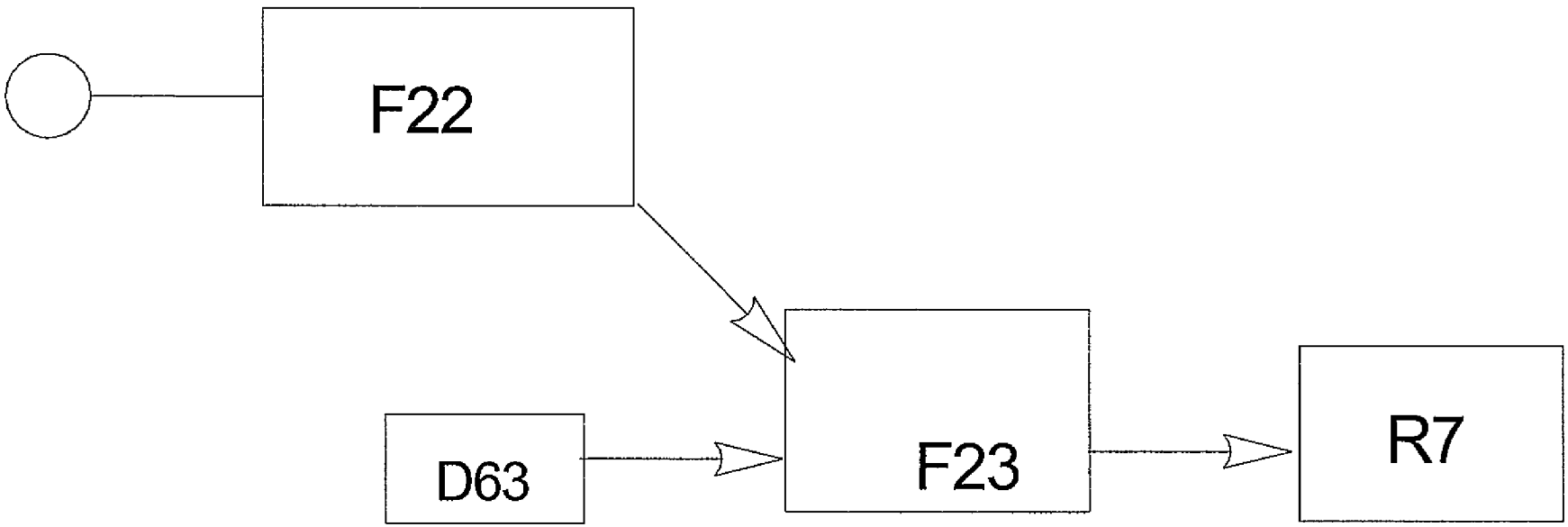
FIG. 27 is a flowchart view of the Network Analysis Module of the computer program to determine Daily Diesel Consumed R7.

FIG. 27 illustrates computation result Daily Diesel Consumed R7, calculated by computing function Daily Diesel Consumed F23. Daily Diesel Consumed F23 is derived by applying function Compressor Horsepower Hours F22 and data input Diesel Consumption D63.

Figure 28:
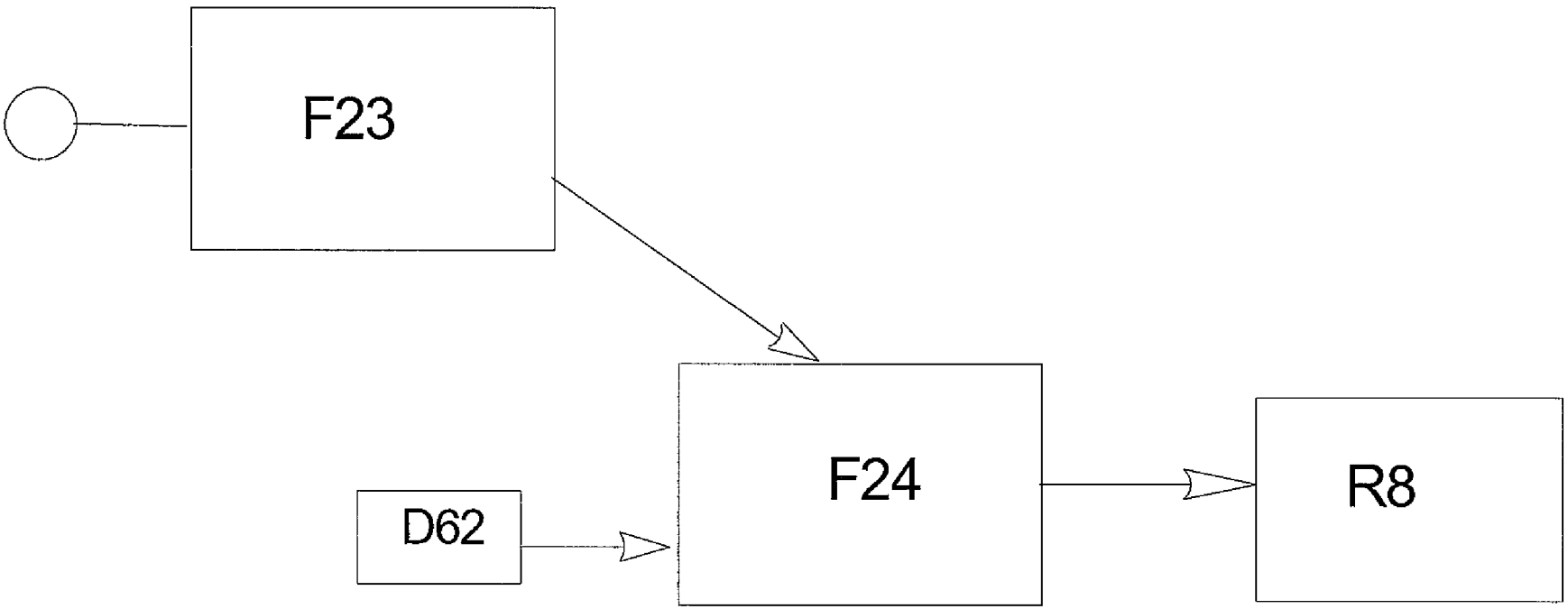
FIG. 28 is a flowchart view of the Network Analysis Module of the computer program to determine Daily Cost R8.

FIG. 28 illustrates computation result Daily Cost R8, calculated by computing function F24. F24 is derived by applying function Daily Diesel Consumed F23 and input data Diesel Cost D62.

Operation—Down Hole Air Diverter

FIG. 5 illustrates operation of down hole air diverter 1000. Surface air is injected into pneumatic inlet piping 9 and pumped down hole through drillpipe 110, through down hole air diverter 1000, and through bottom hole assembly 120', exiting drill bit 140, and returning to the surface through well bore annulus 61. Some air is diverted in down hole air diverter 1000, entering valve assembly 1100 at the first end of entrance port assembly 1200, as illustrated in FIG. 18. The central passageway of entrance port assembly 1200 is in pneumatic communication with piston sleeve annular passageway 3020. Valve assembly 1100 is said to be open when valve assembly 1100 allows pneumatic flow from the first end of entrance port assembly 1200, through piston sleeve annular passageway 3020, around upper piston 1405, and exiting nozzle tip 1700. Valve assembly 1100 is said to be closed when valve assembly 1100 substantially prevents pneumatic flow from the first end of entrance port assembly 1200, exiting nozzle tip 1700.

FIG. 18 shows valve assembly 1100 in a typically closed position as would occur when down hole air diverter 1000 is being run into the well bore. Since there is not any appreciable pneumatic flow from the drillpipe 110, the pneumatic pressure inside pressure chamber 3010 causes upper piston 1405 to remain fully extended and seated in upper piston seat 1610 until such time as the pressure in the drillpipe 110 or wellbore annulus 61 exceeds the pneumatic pressure inside pressure chamber 3010. Pneumatic flow does not significantly exit nozzle tip 1700 without first being activated by a small back pressure. This is accomplished by pneumatic flow entering nozzle tip 1700, pushing upper piston 1405 enough to unseat from upper piston seat 1610 (shown in FIG. 15). The pressure at nozzle tip 1700 must be approximately fifteen to twenty pounds per square inch greater pressure than the pneumatic pressure inside pressure chamber 3010 in order to unseat upper piston 1405.

Figure 19:
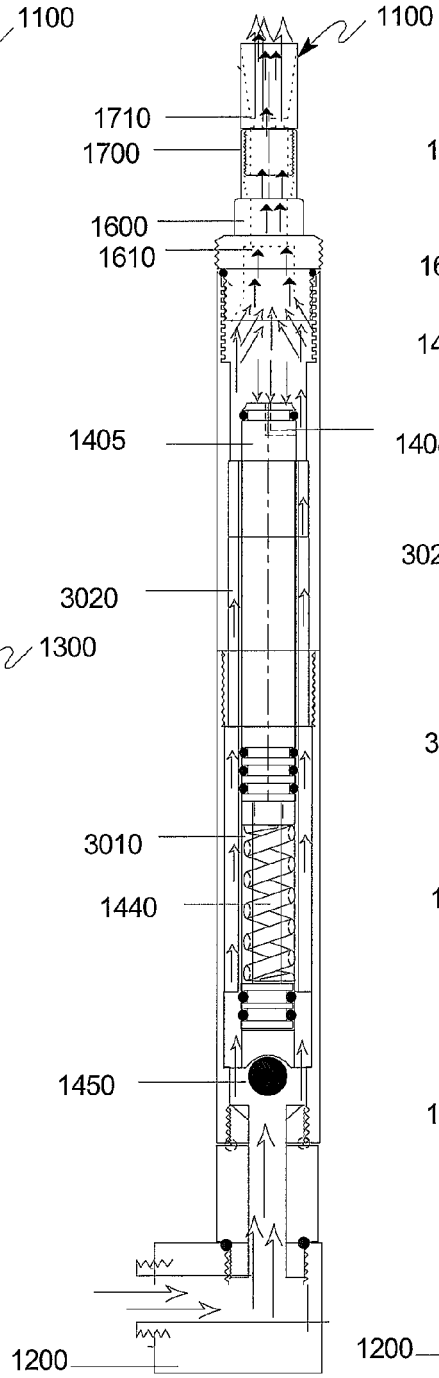
FIG. 19 is a schematic side view of valve assembly 1100 in open position.

Typically, the pneumatic flow from drillpipe 110 pressurizes piston sleeve annular passageway 3020, moving upper piston 1405 to its fully downward position, as illustrated in FIG. 19. The pressure in piston sleeve annular passageway 3020 is typically greater than the pressure in well bore annulus 61 at that depth, owing to the reduction in friction losses of the dynamic movement of pneumatic flow which would otherwise be experienced by flowing through the bottom hole assembly 120 and up well bore 60 to the annular portion of the well bore 60 adjacent to nozzle tip 1700. Therefore, a controlled amount of the pneumatic flow in piston sleeve annular passageway 3020 exits through exit nozzle 1600 and nozzle tip 1700 into well bore annulus 61.

In the event nozzle orifice 1710 should become plugged with debris, bleeder 1408 (illustrated in FIG. 12A) allows pneumatic pressure from entrance port assembly 1200 to flow into nozzle tip 1700. Typically, bleeder 1408 is approximately one-sixteenth inch in diameter and allows a very minute amount of pneumatic fluid to bleed into nozzle tip 1700. As the pressure in nozzle tip 1700 rises to approximately fifteen to twenty pounds per square inch greater pressure over the pneumatic pressure inside pressure chamber 3010, upper piston 1405 will unseat from upper piston seat 1610, causing upper piston 1405 to move down, allowing the pressure in piston sleeve annular passageway 3020 to further push upper piston 1405 into its fully downward position.

Figure 20:
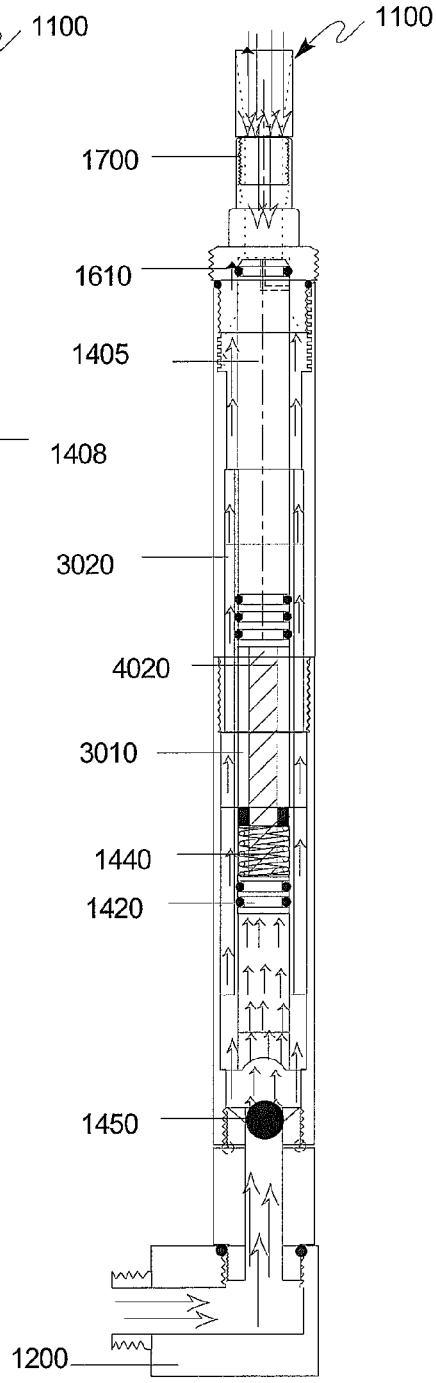
FIG. 20 is a schematic side view of valve assembly 1100 in second closed position, resulting from excessive pressure in drillstring combination 100.

Valve assembly 1100 will remain open until the pneumatic pressure at entrance port assembly 1200 is removed, such as when new sections of drill pipe 110 are added to the drillstring combination 100. Should the pneumatic pressure inside drillstring combination 100 suddenly begin increasing significantly and the wellbore annular pressure that is adjacent nozzle tip 1700 of down hole air diverter 1000 be very low, which indicates a blockage of flow either lower in drillstring combination 100 or in the wellbore below down hole air diverter 1000, as shown in FIG. 20, the great pressure differential will act on the first end of lower piston 1420, causing it to overcome the force of the lower piston compression spring 1440. The second end of lower piston 1420 will move up, coming in contact with and pushing the first end of upper piston 1405. As the pressure from drillstring combination 100 continues to rise, lower piston 1440 will move up, forcing upper piston 1405 into contact with upper piston seat 1610, closing valve assembly 1100. Valve assembly 1100 will remained closed until once again a pressure differential occurs between nozzle tip 1700 and entrance port assembly 1200.

Of significant note, the combination of lower piston 1420, pressure chamber 3010, and upper piston 1405 act together to practically eliminate all valve flutter at upper piston seat 1610.

Operation—Method of Application

In practice, down hole air diverter 1000 is inserted into drillstring combination 100, preferably at the top of bottom hole assembly 120. A nozzle tip 1700 having a particular configuration of nozzle orifices 1710 is used to select the desired amount of pneumatic diversion. A selected total volume of pneumatic fluid is pumped into drillstring combination 100 via pneumatic inlet piping 9.

When using a down hole air diverter 1000 with a percussion hammer, a closing pressure for the percussion hammer is selected. The total flow rate of the pneumatic fluid required to clean the well bore is selected. A first partial flow rate needed to operate said percussion hammer is determined as well as determining the second partial flow rate to be diverted by down hole air diverter 1000; and a nozzle tip 1700 having a particular size of nozzle orifices 1710 is used to select the desired amount of pneumatic diversion.

In each of these applications, the bias pressure of the lower piston compression spring 1440 may be set to select the desired required pressure in the drillstring combination 100 to close the down hole air diverter.

Controlled lift may be achieved by using a plurality of down hole air diverters 1000, inserted at selected locations along drillstring combination 100. Nozzle tips 1700 are selected for each down hole air diverter 1000, as well as the bias pressures of lower piston compression springs 1440, as needed.

Another method of application to reduce slugging and blockage is to set the amount of pneumatic fluid passing through drill bit 140 at the bottom hole to the minimum necessary to lift the smaller cuttings and fluids. A plurality of down hole air diverters 1000 are then configured to maintain a reasonably constant or slightly increasing lift gradient throughout well bore 60 from the bottom of the hole to blooie line 8 at the surface. Thus, optimum transfer of energy occurs and maximum efficiency achieved while also reducing the chances for blockages forming in the well bore.

Figure 29:
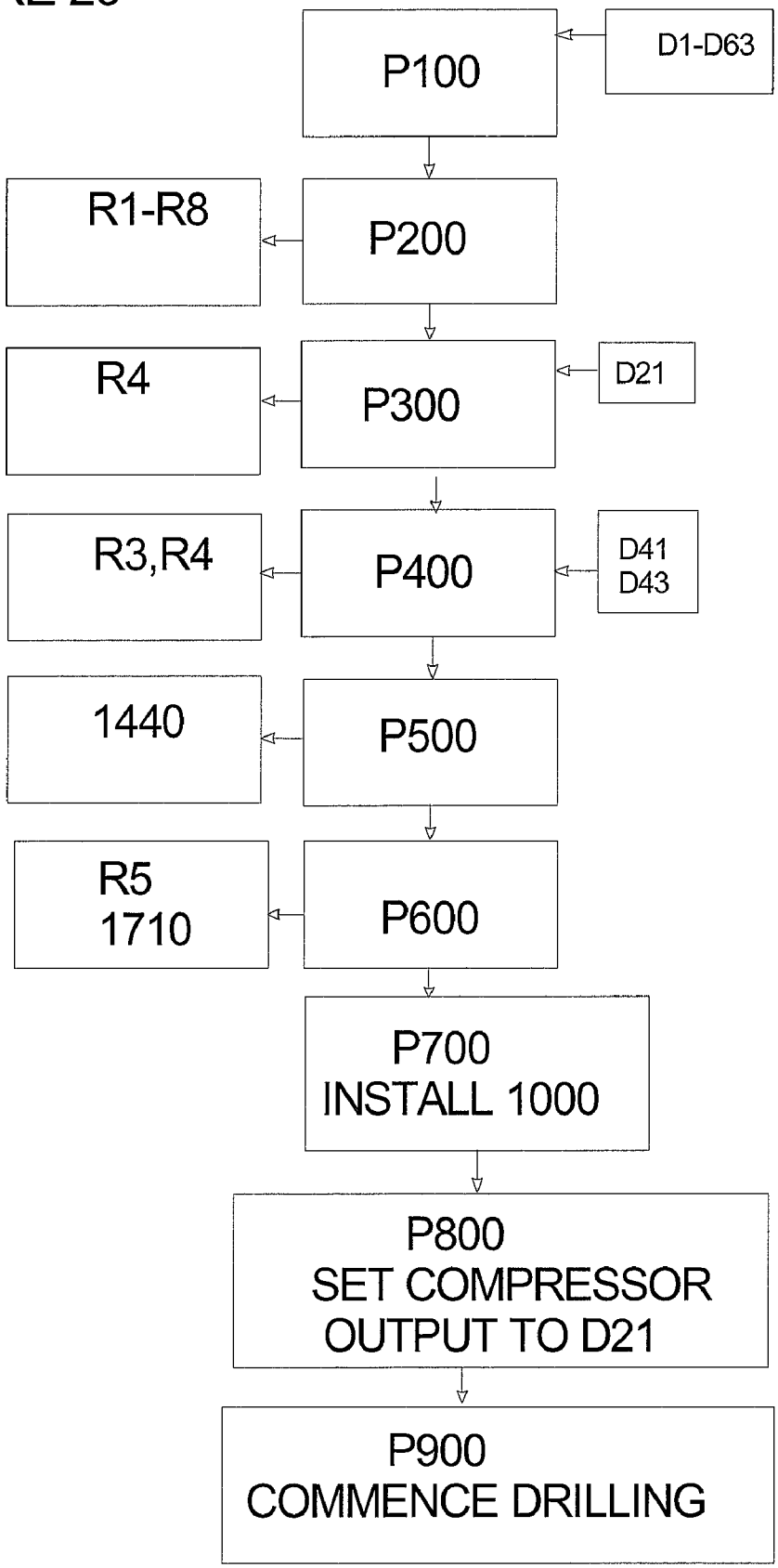
FIG. 29 is a flowchart view of a method of drilling using the present invention.

FIG. 29 illustrates a method of drilling using the present invention. Step P100, gather data inputs D1 through D63 for entry into the Network Analysis Module of the computer program. Set an initial value for Actual Injected Air D21. Step P200, execute Network Analysis Module: Compute functions F1 through F24, producing computational results R1 through R8. Step P300, iteratively execute Network Analysis Module, adjusting Actual Injected Air D21, and alternatively other data inputs, until an acceptable profile for Kinetic Energy Versus Depth R4 is achieved. Step P400, iteratively execute Network Analysis Module, adjusting Diverter One Diversion Volume D41 and Diverter Two Diversion Volume D43, to divert pneumatic fluid away from bottom hole assembly 120, until an acceptable profile for Kinetic Energy Versus Depth R4 or Air Velocity Versus Depth R3 is achieved. Step P500, set compression rating of lower piston compression spring 1440. Step P600, use computational result Nozzle Size R5 to set the diameter of nozzle orifice 1710 of nozzle tip 1700 for each valve assembly 100 to be installed in Downhole Air Diverter Sub 1000. Step P700, install one or more Down Hole Air Diverters 1000 in drillstring combination 100. Step P800, use accepted data input Actual Injected Air D21 to set the total flow of the surface air compressors to drillstring combination 100. Step P900, commence drilling operations.

Operation—Example Application

The following operational example illustrates application of the present invention.

Any time the technology is used to maintain fast penetration rates while producing large amounts of water the following factors need to be considered:

a) economics of disposal and potential for environment damage should pits break;
b) does the increased penetration rate justify the cost of increased water disposal; additional water is produced as a result of lowering the bottom hole pressure to achieve the higher penetration rates; is there a reduction in rig time to offset these cost;
c) comparative economics to mud-up and drill at slower penetration rates; and
d) comparative economics to set pipe and case off the water so that you can continue to drill using air.

If the interval to be drilled is not too long and haul-off expense is reasonable, economically it would be best to use the Down Hole Air Diverter to maintain higher penetration rates.

Having been a drilling manager for several large independents in the Arkoma Basin these last ten years, and very interested in using the best available technology to solve drilling problems led me to study other potential benefits that could be derived from this technology. Drilling activity in the Arkoma Basin has shifted farther east in north central Arkansas into Yale county and to eastern Oklahoma. As a result of this shift the fill problems associated with unstable shale formations has become more significant. It was my exposure to those earlier tools which led me to believe that this same technology, if applied correctly, could be used to minimize or eliminate fill problems, and improve drilling efficiency in general, while using air to remove cutting from the wellbore. However, in order for me to demonstrate how this was possible, an accurate drilling model was necessary which could predict surface and downhole conditions. With this drilling model, the technology can be applied effectively to reduce drilling cost in situations where compressed air is the medium being used to clean the wellbore.

It has been the normal practice, in areas where air drilling is utilized, is to stay on air until "just before you get stuck". The phone call from the drilling foreman at 2 o'clock in the morning saying "we need to mud up" is a great disappointment to the operations superintendent or the drilling engineer. As much as we dislike the thought of having to mud a well up, little research has gone to really understand what downhole dynamics are actually causing the fill problems and what, if any, solutions there are to resolve the problems. Many wells that begin on air eventually have to be mudded up at considerable expense for oil base mud, rig time and other related expense. In regions where fill problems are prevalent, the wells that do reach TD on air are probably the result of luck since little new technology has been used to achieve these successes. The accepted reason given for fill problems is a "rubble zone" or high dip shale formation. It is very possible that these conditions do exist, however very little preventative maintenance has been done to minimize their effects, at least not prior to reaching the culprit zone. Then it is too late. With proper design and field application, many of these problems can be eliminated, as proper hole cleaning may also contribute significantly. Even when the problem is diagnosed correctly, the remedies presently used are partial solutions and may actually worsen the situation.

However, if improved technology is applied correctly, hole cleaning and other problems can be improved, if not eliminated completely.

Two corrective measures used today are to: 1) slow drilling rates and time drill to reduce the cuttings volume, and 2) to increase the volume of air being circulated so that velocities in the disturbed zone will be increased enough to transport the larger cuttings past the low velocity zone and to the surface.

The cuttings volume may have a small contribution to the fill problems. Cuttings volume does not seriously affect wellbore stability until it reaches approximately four percent (4%) of the annular volume rate. It is rare to see fill problems in unconsolidated sandstone formation no matter how fast the drilling rate. The sand grains are small and pass through the low velocity zone above the drill collars, and even some large washout zones, easily, even with velocities considered to be too low. The large cuttings that are being generated from the unstable zone are too large to be transported through the low velocity zone above the drill collars and washout zones. Unless one of the other variables is changed, the only solution is for these cuttings to be ground into smaller particles by having longer contact time with the bit, drill collars and formation in the drill collar annular space. This would require reducing the air volume circulating through the bit and in the drill collar annulus. This is impractical, as it would reduce annular velocities even more in the disturbed area above the collars, most likely leading to a stuck pipe.

In order to increase the circulating volume, surface and downhole pressures must increase. This increase in pressures causes increase in the density of the circulating air and frictional pressure-drop across the annular collar space. This is the primary reason for hole erosion. This method appears to solve the problem. Actually, it only delays ultimate hole failure by a matter of minutes. The particles trapped in the disturbed zone, when the volume is first increased, will usually come out of the hole in a slug. This gives a false indication that the hole is cleaning up. What is actually happening is that the higher velocities and kinetic energy around the collars are now beginning to transport even larger-sized particles to the disturbed area. The length of this disturbed area is also increasing with the increased velocity in the drill collar annulus. The solids accumulation can be estimated by using the following general balance equation:

$$h=(v_i^2-v_o^2)/2g$$

Where h=height of the disturbed zone in ft $v_i$=velocity beside collar annulus in ft/sec $v_o$=velocity beside drillpipe annulus just above collars in ft/sec g=acceleration of gravity in ft/sec$^2$=32.2 ft/sec$^2$ Consider the following example:

Drilling a 7⅞" hole at 6000' with 6¼" collars $v_i$=velocity beside collars is 50 ft/sec $v_o$=velocity beside the drillpipe just above the collars is 35 ft/sec Therefore the height of the disturbed zone h=20'

If you increase the volume of air enough to increase annular velocity next to the drillpipe by ten percent (10%) the length of the disturbed area "h" will actually increase. This worsens the fill problem. It is not how much velocity you have but how much change occurs. Temporarily, you may see some slugging at the surface as an indication the problem improving. The initial velocity increase in the disturbed area will remove some of the smaller fill particles. However, now with increased air volume and velocity through the bit and collar area, larger particles are traveling into the disturbed area. These larger particles experience less contact time with the bit and collars, preventing them from being reduced in size. This worsens the problem. What is needed is a way to clean up the fill by increasing velocities above the collar annulus in the disturbed area or washed out zone without affecting the velocity in the collar area itself This is what the Down Hole Air Diverter accomplishes.

The ideal situation is to have annular velocities steadily increasing from the bit to the surface so that any particle leaving the bottom hole annular area is assured of reaching the surface. Utilizing the Down Hole Air Diverter assures the best chance for successful hole cleaning.

In reviewing drilling data and logs on many wells to develop this model and study the benefits of using the Down Hole Air Diverter, it became apparent that some of the problems which occurred were the result of inadequate drilling practices. Air drilling only accounts for approximately 10% of the wells drilled. The staffs who supervise air drilling for the larger companies usually rely on local expertise, since air drilling is only a small scope of their responsibility. Unfortunately, no concerted effort has been made to solve many of the drilling problems associated with Arkoma Basin. One of the reasons that drilling problems in the basin fail to get proper attention is the fact that most of the operators are independents with little or no technical staff to look for solutions to these problems. The consensus has been that air drilling is easy and does not require engineering expertise. Drilling with air is actually more difficult than with a mud system. A properly engineered air drilled hole takes extensive planning. Putting two compressors on the hole and drilling out with a hammer tool and flat bottom bit may be all that is needed on some wells. However, millions of dollars have been spent mudding up, many times with oil base mud. These are problems that could have been solved more easily, with less of an environmental impact. The preventative procedure used now is to remove the hammer tool and flat bottom bit so stuck pipe and sidetracking can be avoided as the hole is deepened. This is good practice, but doesn't go far enough to solve the real problem, which is how to eliminate the fill. Most fill problems are attributed to a rubble zone or high dip shale formation. Frictional pressure in the collar annulus is the prime cause of hole erosion and fill.

The general rule is to use enough air to supply a minimum velocity of 3000 feet per minute, or 50 feet per second, in the largest annular space, which begins at the top of the drill collars. This rule is a holdover from the mining industry and is really an undefined number that attempts to combine the air mass and velocity into one term for field calculations. It is not recommended to go below these values. As Angel's work is described in Lyons' et al 2001 Update of the "*Air and Gas Drilling Manual*", "kinetic energy" is the most accurate way to describe the total energy the compressed fluid per cubic foot has at any point in the system. By using the air density at surface conditions, the relationship between the general rule and kinetic energy can be made. Lyons' et al goes on to equate this relationship to a mud-drilled well with the same configuration. The following equation defines kinetic energy per cubic foot as it is related to velocity and mass of the compressed fluid. Velocity increases as a result of decreased pressure in the system while mass increases as a result of increased pressure in the system. Increased annular pressure can be the result of friction caused by a too high rate of air circulation in the collar annulus. Mass, although needed, in conjunction with high velocities results in hole erosion.

$$E_{go}=((\gamma_{go})/2g)\cdot v_{go}^2$$

Where, $\gamma_{go}$=0.0765 pound per cubic feet (lb/ft$^3$), Specific weight of air at 14.65 psia and 60° F.

g=32.2 fps$^2$, a constant to convert unit of mass from pound to slug $v_{go}$=50 fps, minimum required velocity air at 14.65 psia and 60° F.

Therefore the kinetic energy of one cubic foot (1 ft$^3$) of standard air moving at 50 fps is:

$$E_{go}=((0.0765)/(2\cdot 32.2))\cdot(50)^2$$

$$E_{go}=2.96 \text{ or about } 3 \text{ ft}\cdot\text{lb/ft}^3$$

Therefore, in order for particles to move from the bit to the surface, the kinetic energy in the system at any point must be above three foot-pounds per cubic foot. This assumption is based on uniform particle size with particle velocity the same as the velocity of the compressed air. Unless there are large washed out sections, the point of lowest kinetic energy in the wellbore annulus is the low velocity zone just above the drill collars. If there is insufficient flow rate of air, where the kinetic energy just above the collars falls below three foot-pounds per cubic foot, then many larger particles will travel up, past the drill collars, and begin to stagnate in the low velocity section just above the collars. To proceed up the annulus, the particles must be reduced in size by colliding with the drillpipe, other particles, and the formation. If larger particles are able to make it past this low velocity zone, eventually kinetic energy will increase as the back (hydrostatic) pressure is reduced sufficiently to propel the particles to the surface. Many times, fill will be expelled as a slug from the well as a result of increased pressure below the low velocity area. However, once slugging begins to occur, wellbore conditions in the annulus become unstable. Drillpipe pressure begins to increase rapidly, which means the velocity is decreasing. If a sufficient gas formation is encountered, the fill problems will diminish as the increased annular velocity can remove the larger particles. Alternatively, if a thick sand formation is drilled, the abrasive nature of the sand will reduce the cuttings-size, allowing the particles to be moved up hole through the low velocity zone. Adding air volume temporarily delays, but ultimately worsens, the effects of the accumulating particles. Ideally, what is needed is a way to increase air velocity above the collars, or in a washed out section, without increasing air pressure, friction and velocity in the collar annulus and bottom hole.

Although the description above contains many specifications, these should not be construed as limiting the scope of the invention but as merely providing illustrations of some of the presently preferred embodiments of this present invention. Persons skilled in the art will understand that the method and apparatus described herein may be practiced, including but not limited to, the embodiments described. Further, it should be understood that the invention is not to be unduly limited to the foregoing which has been set forth for illustrative purposes. Various modifications and alternatives will be apparent to those skilled in the art without departing from the true scope of the invention. While there has been illustrated and described particular embodiments of the present invention, it will be appreciated that numerous changes and modifications will occur to those skilled in the art, and it is intended as herein disclosed to cover those changes and modifications which fall within the true spirit and scope of the present invention.

What is claimed is:

1. A down hole air diverter comprising:

a) a first opening in communication with the central passageway of a drillstring;

b) a second opening in communication with the well bore annulus; and c) a means to control the flow of pneumatic fluid between said first opening and said second opening, wherein said means to control the flow of pneumatic fluid further comprises:

a) a first sealing means to selectably control communication with the well bore annulus, wherein said first sealing means is disposed proximate to said second opening;

b) a first biasing means to control said first sealing means; and c) said first sealing means allowing communication with the well bore annulus when the force exerted by the well bore annulus pressure exceeds the force exerted by said first biasing means and preventing communication with the well bore annulus when the force exerted by the bias pressure of said first biasing means exceeds the force exerted by the well bore annulus pressure.

2. The down hole air diverter of claim 1 further comprising:

a) a means to control the rate of flow of fluid from the central passageway of said drillstring exiting into said well bore annulus.

3. The down hole air diverter of claim 2 wherein said controlled exit means further aligns the exit of said fluid into said well bore annulus in an orientation approximately parallel to the exterior surface of said drillstring.

4. The down hole air diverter of claim 2 wherein said controlled exit means comprises a nozzle.

5. The down hole air diverter of claim 1 wherein said first sealing means further allows communication with the well bore annulus when the force exerted by the drillstring pressure exceeds the force exerted by said first biasing means.

6. The down hole air diverter of claim 1 wherein said first sealing means further allows communication with the well bore annulus when the force exerted by the drillstring pressure, in combination with said force exerted by the well bore annulus pressure, exceeds the force exerted by said first biasing means.

7. The down hole air diverter of claim 1 further comprising a second sealing means forming a chamber between said first opening and said first sealing means, said second sealing means preventing communication with the drillstring when the force exerted by the pressure of said chamber exceeds the force exerted by the pressure at said first opening in communication with the central passageway of a drillstring and allowing communication when the force exerted by the pressure at said first opening in communication with the central passageway of a drillstring exceeds the force exerted by the pressure of said chamber.

8. The down hole air diverter of claim 1 further comprising:

a) a chamber between said first sealing means and the well bore annulus; and b) a bleeding means, allowing communication of said central passageway of a drillstring across said first sealing means to said chamber, thereby allowing said chamber to attempt to equalize to the drillstring pressure should the communication between said chamber and said well bore annulus become blocked, said first sealing means allowing communication between the drill pipe and said chamber when the pressure of said chamber exceeds the pressure of said first biasing means.

9. The down hole air diverter of claim 1 wherein said means to control the flow of pneumatic fluid further comprises:

a) a second biasing means, whereby said first sealing means prevents communication with the well bore annulus when the force exerted by the pressure at said first opening in communication with the central passageway exceeds the force exerted by the pressure of said second biasing means.

10. The down hole air diverter of claim 1 further comprising:

a) a first chamber between said first sealing means and the well bore annulus;

b) a second chamber between said first opening and said first sealing means; and c) said first chamber having a cross sectional flow area less than the cross sectional flow area of said second chamber, whereby the rate of flow of pneumatic fluid from the drill pipe to the well bore annulus is controlled by said first chamber.

11. The down hole air diverter of claim 1 further comprising:

a) a means to align said second opening in communication with the well bore annulus, thereby reducing erosion of the well bore.

12. The down hole air diverter of claim 11 wherein said alignment means comprises:

a) positioning said second opening at approximately a two degree angle relative to the longitudinal axis of said central passageway of the drillstring.

13. The down hole air diverter of claim 1 wherein said first biasing means comprises:

a) a pressure chamber;

b) a piston; and c) a compression spring.

14. The down hole air diverter of claim 1 wherein said first biasing means comprises:

a) a pressure chamber.

15. The down hole air diverter of claim 1 wherein said second opening comprises a nozzle having a detachable tip.

16. The down hole air diverter of claim 1 wherein said second opening comprises a nozzle having a means to adjust the rate of flow of fluid from the central passageway of said drillstring exiting into said well bore annulus.

17. The down hole air diverter of claim 1 used with a percussion hammer and a flat bottom bit.

18. The down hole air diverter of claim 1 used to drill in the presence of formation water.

19. The down hole air diverter of claim 1 used to provide controlled gradient lift in a wellbore annulus.

20. A down hole air diverter comprising:

a) a diverter sub having a central passageway and an exterior surface;

b) a valve assembly attached to said diverter sub comprising:

a) an entrance port in communication with said central passageway of said diverter sub and having a check ball seat;

b) an outer valve body connected to a first opening of said entrance port;

c) a piston-sleeve assembly fitted into said outer valve body, further comprising:

a) a piston sleeve having an upper chamber and a lower chamber;

b) an upper piston having a bottom end, said bottom end of said upper piston moveably positioned into the upper chamber of said piston sleeve;

c) a check ball freely placed between said bottom end of said lower piston and said check ball seat of said entrance port; and d) a plurality of standoff protrusions on the exterior surface of said piston-sleeve assembly forming a passageway between said check ball seat of said entrance port and the upper chamber end of said piston sleeve;

d) a first opening of an exit nozzle having a central passageway connected to a second opening of said outer valve body and shaped to receive said top end of said upper piston; and e) a second opening of said exit nozzle positioned approximately parallel to the longitudinal axis of said central passageway of said diverter sub.

21. The down hole air diverter of claim 20 further comprising:

a) a bleeder in said upper piston forming a passageway between the top end of said upper piston and a side wall of said upper piston.

22. The down hole air diverter of claim 20 further comprising:

a) a lower piston having a top end, said top end of said lower piston moveably positioned into the lower chamber of said piston sleeve; and b) a lower piston compression spring fitted between the lower chamber of said piston sleeve and the bottom end of said lower piston.

23. The down hole air diverter of claim 20 further comprising:

a) a nozzle tip connecting to said second opening of said exit nozzle and having an opening to the exterior surface of said diverter sub.

24. The down hole air diverter of claim 20 further comprising:

a) a nozzle tip connecting to said second opening of said exit nozzle and having an opening to the exterior surface of said diverter sub; and b) a portion of said exterior surface of said diverter sub tapered at approximately a two degree angle relative to said opening of said nozzle tip.

25. The down hole air diverter of claim 20 further comprising:

a) a bleeder in said upper piston forming a passageway between the top end of said upper piston and a side wall of said upper piston;

b) a lower piston having a top end, said top end of said lower piston moveably positioned into the lower chamber of said piston sleeve;

c) a lower piston compression spring fitted between the lower chamber of said piston sleeve and the bottom end of said lower piston;

d) a nozzle tip connecting to said second opening of said exit nozzle and having an opening to the exterior surface of said diverter sub; and e) a portion of said exterior surface of said diverter sub tapered at approximately a two degree angle relative to said opening of said nozzle tip.

26. A down hole air diverter comprising:

a first opening in communication with the central passageway of a drillstring;

a second opening in communication with the well bore annulus;

a means to control the flow of pneumatic fluid between said first opening and said second opening, wherein said means to control the flow of pneumatic fluid further comprises:

a first sealing means to selectably control communication with the well bore annulus;

a first biasing means to control said first sealing means; and said first sealing means allowing communication with the well bore annulus when the force exerted by the well bore annulus pressure exceeds the force exerted by said first biasing means and preventing communication with the well bore annulus when the force exerted by the bias pressure of said first biasing means exceeds the force exerted by the well bore annulus pressure; and a second sealing means forming a chamber between said first opening and said first sealing means, said second sealing means preventing communication with the drillstring when the force exerted by the pressure of said chamber exceeds the force exerted by the pressure at said first opening in communication with the central passageway of a drillstring and allowing communication when the force exerted by the pressure at said first opening in communication with the central passageway of a drillstring exceeds the force exerted by the pressure of said chamber.

27. A down hole air diverter comprising:

a first opening in communication with the central passageway of a drillstring;

a second opening in communication with the well bore annulus;

a means to control the flow of pneumatic fluid between said first opening and said second opening, wherein said means to control the flow of pneumatic fluid further comprises:

a first sealing means to selectably control communication with the well bore annulus;

a first biasing means to control said first sealing means; and said first sealing means allowing communication with the well bore annulus when the force exerted by the well bore annulus pressure exceeds the force exerted by said first biasing means and preventing communication with the well bore annulus when the force exerted by the bias pressure of said first biasing means exceeds the force exerted by the well bore annulus pressure;

a chamber between said first sealing means and the well bore annulus; and a bleeding means, allowing communication of said central passageway of a drillstring across said first sealing means to said chamber, thereby allowing said chamber to attempt to equalize to the drillstring pressure should the communication between said chamber and said well bore annulus become blocked, said first sealing means allowing communication between the drill pipe and said chamber when the pressure of said chamber exceeds the pressure of said first biasing means.

28. A down hole air diverter comprising:

a first opening in communication with the central passageway of a drillstring;

a second opening in communication with the well bore annulus;

a means to control the flow of pneumatic fluid between said first opening and said second opening, wherein said means to control the flow of pneumatic fluid further comprises:

a first sealing means to selectably control communication with the well bore annulus;

a first biasing means to control said first sealing means; and said first sealing means allowing communication with the well bore annulus when the force exerted by the well bore annulus pressure exceeds the force exerted by said first biasing means and preventing communication with the well bore annulus when the force exerted by the bias pressure of said first biasing means exceeds the force exerted by the well bore annulus pressure; and a second biasing means, whereby said first sealing means prevents communication with the well bore annulus when the force exerted by the pressure at said first opening in communication with the central passageway exceeds the force exerted by the pressure of said second biasing means.

* * * * *